US008863827B2

(12) United States Patent
Falk et al.

(10) Patent No.: US 8,863,827 B2
(45) Date of Patent: Oct. 21, 2014

(54) JET PUMP FOR USE WITH A MULTI-STRING TUBING SYSTEM AND METHOD OF USING THE SAME FOR WELL CLEAN OUT AND TESTING

(75) Inventors: Kelvin L. Falk, Calgary (CA); Collin Morris, Lloydminister (CA)

(73) Assignee: 1497690 Alberta Ltd., Calgary (CA)

( * ) Notice: Subject to any disclaimer, the term of this patent is extended or adjusted under 35 U.S.C. 154(b) by 369 days.

(21) Appl. No.: 12/721,409

(22) Filed: Mar. 10, 2010

(65) Prior Publication Data

US 2010/0230107 A1 Sep. 16, 2010

Related U.S. Application Data

(60) Provisional application No. 61/158,977, filed on Mar. 10, 2009.

(51) Int. Cl.

| | |
|---|---|
| ***E21B 43/00*** | (2006.01) |
| ***F04F 1/20*** | (2006.01) |
| ***F04F 5/46*** | (2006.01) |
| ***F04F 5/54*** | (2006.01) |
| ***E21B 37/00*** | (2006.01) |

(52) U.S. Cl.

CPC . *E21B 37/00* (2013.01); *F04F 1/20* (2013.01); *F04F 5/461* (2013.01); *F04F 5/54* (2013.01)

USPC ..... 166/68; 166/105; 166/372; 166/312

(58) Field of Classification Search

USPC ..... 166/263, 250.01, 370, 372, 68, 105, 166/77.2, 313, 311, 312; 417/151, 176, 417/181; 406/153

See application file for complete search history.

(56) References Cited

U.S. PATENT DOCUMENTS

| | | | | |
|---|---|---|---|---|
| 1,555,232 A | | 9/1925 | Strait | |
| 1,758,376 A | * | 5/1930 | Sawyer | 166/312 |
| 1,791,292 A | * | 2/1931 | Smith | 417/151 |

(Continued)

FOREIGN PATENT DOCUMENTS

| | | |
|---|---|---|
| CA | 1179251 | 11/1984 |
| CA | 1 179 251 | 12/1984 |

(Continued)

OTHER PUBLICATIONS

U.S. Non-Final Office Action corresponding to U.S. Appl. No. 12/788,104 dated Jun. 14, 2012.

(Continued)

*Primary Examiner* — Kenneth L Thompson
(74) *Attorney, Agent, or Firm* — Dentons US LLP

(57) ABSTRACT

A jet pump and method of using the jet pump for removing fluids and solids from a conduit. The jet pump is adapted for use with a spoolable multi-string tubing system. The jet pump may be deployed rapidly and is suitable for temporary installation. The method may be used to reestablish flow in watered out and sanded off wells, or to test wells. The jet pump is adapted to remove wellbore fluid, which may be removed in combination with power fluid. The spoolable multi-string tubing system includes two or more substantially parallel conduits, allowing power fluid and return fluid to flow in separate conduits. Preferred embodiments provide additional functionality by inclusion of jetting elements, sensing elements, back-pressure valves, and auxiliary tubing strings or communication members in the spoolable multi-string tubing system.

15 Claims, 37 Drawing Sheets

(56) References Cited

U.S. PATENT DOCUMENTS

| | | | | |
|---|---|---|---|---|
| 1,867,876 | A * | 7/1932 | Clark | 406/153 |
| 2,080,623 | A * | 5/1937 | McMahon | 417/76 |
| 2,722,895 | A * | 11/1955 | De Porter | 417/160 |
| 2,798,435 | A * | 7/1957 | Armstrong | 417/80 |
| 4,280,662 | A | 7/1981 | Erickson et al. | |
| 4,374,530 | A | 2/1983 | Walling | |
| 4,441,861 | A | 4/1984 | Canalizo | |
| 4,658,893 | A | 4/1987 | Black | |
| 4,718,486 | A * | 1/1988 | Black | 166/68 |
| 4,988,389 | A * | 1/1991 | Adamache et al. | 166/302 |
| 5,033,545 | A | 7/1991 | Sudol | |
| 5,055,002 | A | 10/1991 | Roeder | |
| 5,083,609 | A | 1/1992 | Coleman | |
| 5,372,190 | A | 12/1994 | Coleman | |
| 6,167,960 | B1 | 1/2001 | Moya | |
| 6,250,389 | B1 | 6/2001 | Sudol | |
| 6,330,915 | B1 | 12/2001 | Moya | |
| 6,354,371 | B1 | 3/2002 | O'Blanc | |
| 7,048,514 | B2 | 5/2006 | khomynets | |
| 7,152,683 | B2 | 12/2006 | Khomynets | |
| 7,172,038 | B2 | 2/2007 | Terry et al. | |
| 7,222,675 | B2 | 5/2007 | Williams | |
| 7,255,175 | B2 | 8/2007 | Jackson et al. | |
| 7,273,108 | B2 * | 9/2007 | Misselbrook | 166/381 |
| 7,347,259 | B2 | 3/2008 | Ravensbergen et al. | |
| 7,516,792 | B2 | 4/2009 | Lonnes et al. | |
| 7,658,229 | B2 * | 2/2010 | Becker et al. | 166/372 |
| 7,909,089 | B2 | 3/2011 | Jackson | |
| 8,118,103 | B2 | 2/2012 | Williams | |
| 8,122,862 | B2 | 2/2012 | Hicks | |
| 8,122,962 | B2 * | 2/2012 | Croteau | 166/311 |
| 2007/0020114 | A1 * | 1/2007 | McFarland et al. | 417/151 |
| 2007/0187111 | A1 | 8/2007 | Misselbrook et al. | |
| 2008/0314578 | A1 | 12/2008 | Jackson | |
| 2010/0230107 | A1 | 9/2010 | Falk et al. | |
| 2010/0247345 | A1 | 9/2010 | Morris | |
| 2011/0067883 | A1 * | 3/2011 | Falk et al. | 166/369 |

FOREIGN PATENT DOCUMENTS

| | | |
|---|---|---|
| CA | 1 325 969 | 1/1994 |
| CA | 1325969 | 1/1994 |
| CA | 2438877 | 10/2002 |
| CA | 2602964 | 5/2006 |
| CA | 2 602 964 | 10/2006 |
| CA | 2 193 923 | 1/2007 |
| CA | 2193923 | 1/2007 |
| CA | 2635526 | 12/2008 |
| GB | 2 107 397 | 4/1983 |
| GB | 2107397 | 4/1983 |
| WO | 9429571 | 12/1994 |
| WO | WO 94/29571 | 12/1994 |
| WO | 2009049420 | 4/2009 |

OTHER PUBLICATIONS

Chen, S. et al., "An Integrated Sand Cleanout System by Employing Jet Pumps," Journal of Canadian Petroleum Technology (JCPT), May 2009, vol. 48, No. 5, pp. 17-23.

Final Office Action mailed on Feb. 28, 2013, U.S. Appl. No. 12/788,104, 6 pages.

Advisory Action mailed on May 14, 2013, U.S. Appl. No. 12/788,104, 3 pages.

* cited by examiner

FLUID CLEANOUT AND JETTING MODE

FLUID CLEANOUT AND JETTING MODE

FLUID CLEANOUT AND JETTING MODE

FLUID CLEANOUT MODE

FLUID CLEANOUT AND JETTING MODE

FLUID CLEANOUT AND JETTING MODE

JET PUMP FOR USE WITH A MULTI-STRING TUBING SYSTEM AND METHOD OF USING THE SAME FOR WELL CLEAN OUT AND TESTING

CROSS REFERENCE TO RELATED APPLICATIONS

This application claims the benefit of priority of U.S. Provisional Patent Application No. 61/158,977 filed Mar. 10, 2009, which is incorporated herein by reference in its entirety.

FIELD OF THE INVENTION

The present invention relates generally to jet pumps. More particularly, the present invention relates to jet pumps for clean out and testing of a conduit.

BACKGROUND OF THE INVENTION

Various oil and gas well operations will benefit from a suitable system allowing rapid deployment of temporary equipment to allow rapid and efficient removal of liquids and entrained solids from a wellbore. Preferably, such a system further provides a method for removing solids, for example sand or formation fines, which block the wellbore. In one application, it may be desirable to remove a fixed quantity of wellbore fluid to reestablish flow in a gas well.

A common technique used to remove wellbore fluid from a wellbore includes running conventional coiled tubing into the well and pumping compressed air or nitrogen gas into the wellbore to gas lift the fluid to surface. This approaches may overpressure the wellbore, pushing at least a portion of the wellbore fluid back into the formation (as opposed to being pumped to the surface). Furthermore, nitrogen gas is costly, while use of compressed air carries safety concerns.

Following fracturing of a well, it may be desirable to have available a rapidly-deployable temporary system to remove fracture treatment fluid from the well. Preferably, the system would is capable of reporting real-time data pertaining to conditions such as flowing bottomhole pressure and temperature. The data facilitates assessment of reservoir characteristics and determination of optimal permanent production and pumping equipment. Without installing permanent pumping equipment, the options to accomplish the above are otherwise limited.

Jet pumps are useful in a wide range of well applications. Nonetheless, jet pumps for use in hydrocarbon recovery are a relatively underdeveloped technology.

U.S. Pat. No. 5,372,190 discloses a downhole jet pump useful with various types of wells, including gas wells which produce a large ratio of water and may include considerable abrasive solid materials. The downhole jet pump can be run and retrieved inside coil tubing, or conventional threaded pipe, of relatively small diameters. The embodiments of the jet pump disclosed enable removal, replacement or adjustment to provide optimum operation of the pump in accordance with installation requirements without the use of special tools.

To date, jet pump systems have been installed using either conventional jointed tubing or conventional coiled tubing. In some of these installations, the process requires that there be two strings installed in the well. Where two strings are used, they are most typically configured as a tubing string inside of a tubing string, or a concentric configuration. In most of these applications the tubing systems are not adapted for rapid deployment and retrieval.

U.S. Pat. No. 5,033,545 discloses a jet pump that brings a power fluid to sedimented solids and the like plugging a conduit, and includes at least one nozzle which directs the power fluid in a high-velocity jet against the solids to bring the solids into suspension for subsequent removal thereof using the jet pump principle.

There are operational and technical advantages to configuring the system with two or more parallel tubing strings or electrical conductors. However, until recently significant practical problems with this approach had not been addressed. The present invention provides a jet pump which is readily deployed and installed in a wellbore using a single conventional coiled tubing unit. Combining the jet pump with a spoolable multi-string tubing system facilitates a broad range of applications.

It is, therefore, desirable to provide a system and method for jet pump and multi-string tubing for well clean out and testing.

SUMMARY OF THE INVENTION

It is an object of the present invention to obviate or mitigate at least one disadvantage of previous jet pumps.

In a first aspect, the present invention provides a jet pump adapted for use with a spoolable multi-string tubing system including two or more conduits, the conduits including a supply tubing string and a return tubing string laterally disposed with respect to one another, the conduits being substantially parallel, and the jet pump including a body; a power fluid inlet in the body for connecting to the supply tubing string; a venturi nozzle and a diffuser in fluid communication with the power fluid inlet; a venture gap between the venturi nozzle and the diffuser for creating a low pressure condition at the venturi gap when power fluid flows through the venturi nozzle and past the venturi gap; a jet pump intake in fluid communication with the venturi gap for flow of wellbore fluid into the jet pump intake when the low pressure condition is created, the wellbore fluid combining with power fluid to form return fluid at the venturi gap; a return tube in fluid communication with the diffuser for receiving the return fluid from the diffuser; and a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string.

In an embodiment of the invention, the jet pump includes a jetting sub having an uphole end and a downhole end, the jetting sub in fluid communication with the power fluid inlet for emitting jetting fluid externally to the jet pump.

In an embodiment of the invention, the jetting sub includes a back-pressure valve.

In an embodiment of the invention, the back-pressure valve includes a ball, spring, and seat.

In an embodiment of the invention, the jetting sub includes a jetting nozzle proximate the downhole end for flowing jetting fluid out of.

In an embodiment of the invention, the jetting sub includes an upper flow choke proximate the uphole end for limiting flow of fluid if the jetting nozzle washes out.

In an embodiment of the invention, the upper flow choke is adapted to limit flow of jetting fluid that may otherwise occur if the jetting nozzle washes out.

In an embodiment of the invention, the jetting sub includes one or more lateral jetting ports oriented at an angle relative to a longitudinal axis of the jetting sub of between about −15 degrees and about +15 degrees.

In an embodiment of the invention, the jetting nozzle includes a converging jetting passage and a diverging jetting passage, the converging jetting passage and the diverging jetting passage forms a jetting pinch, the dimensions of the jetting pinch selected to provide back-pressure for the jetting nozzle.

In an embodiment of the invention, the jetting nozzle includes an abrasion-resistant elastomeric insert located radially outward from the diverging jetting passage.

In an embodiment of the invention, the jetting nozzle includes a jetting passage insert reversibly connected with the jetting nozzle, the converging jetting passage being present on the insert.

In an embodiment of the invention, the jetting nozzle includes a disposable nose reversibly connected with the jetting nozzle, the diverging jetting passage being present on the disposable nose.

In an embodiment of the invention, the jet pump intake includes slots having an opening dimension selected relative to the venturi gap to prevent intake of particulates large enough to plug the venturi gap.

In an embodiment of the invention, the slots include an opening dimension selected relative to the venturi gap.

In an embodiment of the invention, the jet pump including a check valve.

In an embodiment of the invention, the jet pump wherein the body is a unibody jet pump body.

In an embodiment of the invention, the jet pump wherein the body is a double-barrel jet pump body.

In an embodiment of the invention, the jet pump including a jetting flow passage and a venturi inlet, the jetting flow passage in fluid communication with the venturi inlet, and the jetting sub in fluid communication with the jetting flow passage.

In an embodiment of the invention, the two or more conduits include a supply tubing string and a return tubing string.

In an embodiment of the invention, the two or more conduits include a supply tubing string, a return tubing string, and an auxiliary tubing string.

In an embodiment of the invention, the two or more conduits include a supply tubing string, a return tubing string, and an auxiliary tubing string, the jetting flow passage is in fluid communication with the auxiliary tubing string, and the jetting sub in fluid communication with the jetting flow passage.

In an embodiment of the invention, the two or more conduits further include a communications line, and the jet pump further including a data-sensing sub for operative communication with the communications line.

In an embodiment of the invention, the jet pump includes a data-sensing sub.

In an embodiment of the invention, the two or more conduits further include a communications line, the jet pump further including a jetting flow valve for operative communication with the communications line, the jetting flow valve for changing between allowing and preventing fluid communication between the power fluid inlet and the jetting sub.

In an embodiment of the invention, the jet pump includes a jetting flow valve located along the jetting flow passage, the jetting flow valve operatively connected with the communications line, and the jetting flow valve adapted to selectively obstruct flow of jetting fluid through the jetting flow passage.

In a further aspect, the present invention provides a method of cleaning a wellbore including:

providing a spoolable multi-string tubing system including two or more conduits, the two or more conduits including a supply tubing string and a return tubing string;

providing a jet pump including a jet pump intake, a venturi nozzle, a venturi gap, and a diffuser a body; a power fluid inlet in the body for connecting to the supply tubing string; a venturi nozzle and a diffuser in fluid communication with the power fluid inlet; a venturi gap between the venturi nozzle and the diffuser for creating a low pressure condition at the venturi gap when power fluid flows through the venturi nozzle and past the venturi gap; a jet pump intake in fluid communication with the venturi gap for flow of wellbore fluid into the jet pump intake when the low pressure condition is created, the wellbore fluid combining with power fluid to form return fluid at the venturi gap; a return tube in fluid communication with the diffuser for receiving the return fluid from the diffuser; a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string;

establishing fluid communication between the two or more conduits and the jet pump;

deploying the jet pump into the wellbore;

providing power fluid to the jet pump via the supply tubing string; and receiving return fluid from the jet pump via the return tubing string.

In a further aspect, the present invention provides a method of cleaning a wellbore including:

providing a spoolable multi-string tubing system including two or more conduits, the two or more conduits including a supply tubing string and a return tubing string;

providing a jet pump including a body; a power fluid inlet in the body for connecting to the supply tubing string; a venturi nozzle and a diffuser in fluid communication with the power fluid inlet; a venturi gap between the venturi nozzle and the diffuser for creating a low pressure condition at the venturi gap when power fluid flows through the venturi nozzle and past the venturi gap; a jet pump intake in fluid communication with the venturi gap for flow of wellbore fluid into the jet pump intake when the low pressure condition is created, the wellbore fluid combining with power fluid to form return fluid at the venturi gap; a return tube in fluid communication with the diffuser for receiving the return fluid from the diffuser; a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string; and a jetting sub in fluid communication with the power fluid inlet for emitting jetting fluid externally to the jet pump;

establishing fluid communication between the two or more conduits and the jet pump;

deploying the jet pump into the wellbore;

providing power fluid to the jet pump via the supply tubing string; and receiving return fluid from the jet pump via the return tubing string.

In an embodiment of the invention, the method includes flowing jetting fluid out of the jetting nozzle while receiving return fluid from the jet pump via the return tubing string.

In an embodiment of the invention, the method includes:

ceasing to receive return fluid from the jet pump via the return tubing string;

flowing jetting fluid out of the jetting sub;

ceasing to flow jetting fluid out of the jetting sub; and receiving return fluid from the jet pump via the return tubing string.

In a further aspect, the present invention provides a method of cleaning a wellbore including:

providing a spoolable multi-string tubing system including two or more conduits, the two or more conduits including a supply tubing string and a return tubing string;

providing a body; a power fluid inlet in the body for connecting to the supply tubing string; a venturi nozzle and a diffuser in fluid communication with the power fluid inlet; a venturi gap between the venturi nozzle and the diffuser for creating a low pressure condition at the venturi gap when power fluid flows through the venturi nozzle and past the venturi gap; a jet pump intake in fluid communication with the venturi gap for flow of wellbore fluid into the jet pump intake when the low pressure condition is created, the wellbore fluid combining with power fluid to form return fluid at the venturi gap; a return tube in fluid communication with the diffuser for receiving the return fluid from the diffuser; a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string; and a jetting sub including a back-pressure valve, the jetting sub in fluid communication with the power fluid inlet for emitting jetting fluid externally to the jet pump;

establishing fluid communication between the two or more conduits and the jet pump;

deploying the jet pump into the wellbore;

providing power fluid to the jet pump via the supply tubing string; and receiving return fluid from the jet pump via the return tubing string.

In an embodiment of the invention, the method includes flowing jetting fluid out of the jetting nozzle while receiving return fluid from the jet pump via the return tubing string.

In an embodiment of the invention, the method includes:

ceasing to receive return fluid from the jet pump via the return tubing string;

flowing jetting fluid out of the jetting sub;

ceasing to flow jetting fluid out of the jetting sub; and receiving return fluid from the jet pump via the return tubing string.

In a further aspect, the present invention provides a method of cleaning a wellbore including:

providing a spoolable multi-string tubing system including two or more conduits, the two or more conduits including a supply tubing string, a return tubing string, and a communications line;

providing a body; a power fluid inlet in the body for connecting to the supply tubing string; a venturi nozzle and a diffuser in fluid communication with the power fluid inlet; a venturi gap between the venturi nozzle and the diffuser for creating a low pressure condition at the venturi gap when power fluid flows through the venturi nozzle and past the venturi gap; a jet pump intake in fluid communication with the venturi gap for flow of wellbore fluid into the jet pump intake when the low pressure condition is created, the wellbore fluid combining with power fluid to form return fluid at the venturi gap; a return tube in fluid communication with the diffuser for receiving the return fluid from the diffuser; a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string; and a data-sensing sub for operative communication with the communications line;

establishing fluid communication between the jet pump and the supply tubing string, and between the return tubing string and the jet pump;

establishing an operative connection between the data-sensing sub and the communications line;

deploying the jet pump into the wellbore;

sensing data with the data-sensing sub; and receiving the data at the surface via the communications line.

In an embodiment of the invention, the method includes providing power fluid to the jet pump via the supply tubing string and receiving return fluid from the jet pump via the return tubing string.

In a further aspect, the present invention provides a method of cleaning a wellbore including:

providing a spoolable multi-string tubing system including two or more conduits, the two or more conduits including a supply tubing string, a return tubing string, and a communications line;

providing a body; a power fluid inlet in the body for connecting to the supply tubing string; a venturi nozzle and a diffuser in fluid communication with the power fluid inlet; a venturi gap between the venturi nozzle and the diffuser for creating a low pressure condition at the venturi gap when power fluid flows through the venturi nozzle and past the venturi gap; a jet pump intake in fluid communication with the venturi gap for flow of wellbore fluid into the jet pump intake when the low pressure condition is created, the wellbore fluid combining with power fluid to form return fluid at the venturi gap; a return tube in fluid communication with the diffuser for receiving the return fluid from the diffuser; a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string; a jetting sub in fluid communication with the power fluid inlet for emitting jetting fluid externally to the jet pump; and a data-sensing sub for operative communication with the communications line;

establishing fluid communication between the two or more conduits and the jet pump;

establishing an operative connection between the data-sensing sub and the communications line;

deploying the jet pump into the wellbore;

sensing data with the data-sensing sub; and receiving the data at the surface.

In an embodiment of the invention, the method includes providing power fluid to the jet pump via the supply tubing string and receiving return fluid from the jet pump via the return tubing string.

In an embodiment of the invention, the method includes flowing jetting fluid out of the jetting nozzle while receiving return fluid from the jet pump via the return tubing string.

In an embodiment of the invention, the method includes:

ceasing to receive return fluid from the jet pump via the return tubing string;

flowing jetting fluid out of the jetting sub;

ceasing to flow jetting fluid out of the jetting sub; and receiving return fluid from the jet pump via the return tubing string.

In a further aspect, the present invention provides a method of cleaning a wellbore including:

providing a spoolable multi-string tubing system including two or more conduits, the two or more conduits including a supply tubing string, a return tubing string, and an auxiliary tubing string;

providing a jet pump including a jet pump intake, a venturi nozzle, a venturi gap, a diffuser, a jetting flow passage, and a jetting sub;

establishing fluid communication between the two or more conduits and the jet pump;

deploying the jet pump into the wellbore;

providing power fluid to the jet pump via the supply tubing string; and receiving return fluid from the jet pump via the return tubing string.

In an embodiment of the invention, the method includes flowing jetting fluid out of the jetting sub while receiving return fluid from the jet pump via the return tubing string.

In an embodiment of the invention, the method includes:

ceasing to receive return fluid from the jet pump via the return tubing string;

flowing jetting fluid out of the jetting sub;

ceasing to flow jetting fluid out of the jetting sub; and receiving return fluid from the jet pump via the return tubing string.

In a further aspect, the present invention provides a method of cleaning a wellbore including:

providing a spoolable multi-string tubing system including two or more conduits, the two or more conduits including a supply tubing string, a return tubing string, and a communications line;

providing a jet pump including a jet pump intake, a venturi nozzle, a venturi gap, a diffuser, a jetting sub, a jetting flow passage, and a jetting flow valve;

establishing fluid communication between the jet pump and the supply tubing string, and between the return tubing string and the jet pump;

establishing an operative connection between the jetting flow valve and the communications line;

deploying the jet pump into the wellbore;

providing power fluid to the jet pump via the supply tubing string; and receiving return fluid from the jet pump via the return tubing string.

In an embodiment of the invention, the method includes flowing jetting fluid out of the jetting nozzle while receiving return fluid from the jet pump via the return tubing string.

In an embodiment of the invention, the method includes:

ceasing to receive return fluid from the jet pump via the return tubing string;

flowing jetting fluid out of the jetting sub;

ceasing to flow jetting fluid out of the jetting sub; and receiving return fluid from the jet pump via the return tubing string.

In a further aspect, the present invention provides a method of cleaning a wellbore including:

providing a spoolable multi-string tubing system including two or more conduits, the two or more conduits including a supply tubing string, a return tubing string, a first communications line, and a second communications line;

providing a jet pump including a jet pump intake, a venturi nozzle, a venturi gap, a diffuser, a jetting sub, a jetting flow passage, a data-sensing sub, and a jetting flow valve;

establishing fluid communication between the jet pump and the supply tubing string, and between the return tubing string and the jet pump;

establishing an operative connection between the data-sensing sub and the first communications line;

establishing an operative connection between the jetting flow valve and the second communications line;

deploying the jet pump into the wellbore;

sensing data with the data-sensing sub; and receiving the data at the surface.

In an embodiment of the invention, the method includes providing power fluid to the jet pump via the supply tubing string; and receiving return fluid from the jet pump via the return tubing string.

In an embodiment of the invention, the method includes flowing jetting fluid out of the jetting nozzle while receiving return fluid from the jet pump via the return tubing string.

In an embodiment of the invention, the present invention provides a method of cleaning a wellbore further including:

ceasing to receive return fluid from the jet pump via the return tubing string;

flowing jetting fluid out of the jetting sub;

ceasing to flow jetting fluid out of the jetting sub; and receiving return fluid from the jet pump via the return tubing string.

In a further aspect, the present invention provides a jetting sub for a jet pump including a jetting nozzle and a back-pressure valve.

In an embodiment of the invention, the back-pressure valve includes a ball, spring, and seat, the spring adapted to resist compression when exposed to fluid pressures lower than a selected back-pressure setting.

Other aspects and features of the present invention will become apparent to those ordinarily skilled in the art upon review of the following description of specific embodiments of the invention in conjunction with the accompanying Figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a device and method for cleaning out and testing wells and other conduits using a jet pump and tubing. The present invention may be used as a rapid-deployment process to reestablish flow in, for example, watered or sanded off wells, or as a well testing system. The present invention may also be useful in treatment of, for example, oil, gas, or water wells. The present invention may also be useful in, for example, servicing water supply wells and water disposal wells. The present invention may also be useful in treatment of conduits that are, for example, vertical, horizontal, slanted, or directional, and for pipelines and other conduits. The present invention may also be useful in, for example, post-drilling or post-completion clean-out of sand or fluid to prepare a well for testing or production, testing to assess the productive capacity of a well, and work-over of a producing well or pipeline to restore productive capacity.

The present invention may also be useful in, for example, static pressure and draw-down well servicing, or successive static pressure and draw-down. Static pressure well servicing is performed by equalizing jetting rate with pumping rates or by top-filling the well, in either case to maintain fluid balance, resulting in no reservoir inflow to the wellbore during clean-out. Draw-down well servicing is achieved through pumping more fluid than jetting, and results in a net removal of fluids from the well.

The present invention may also be useful in, for example, injecting chemicals that limit or enhance production from portions of the well using a segregated injection string or power fluid jetting fraction, and then pumping the chemicals out using the jet pump function. The present invention may also be useful in, for example, pumping from sections of a vertical or horizontal well, optionally with isolation provided by, for example, packers, to enhance fluid recovery from portions of a well wherein incremental draw-down is appropriate.

System

Figure 1:
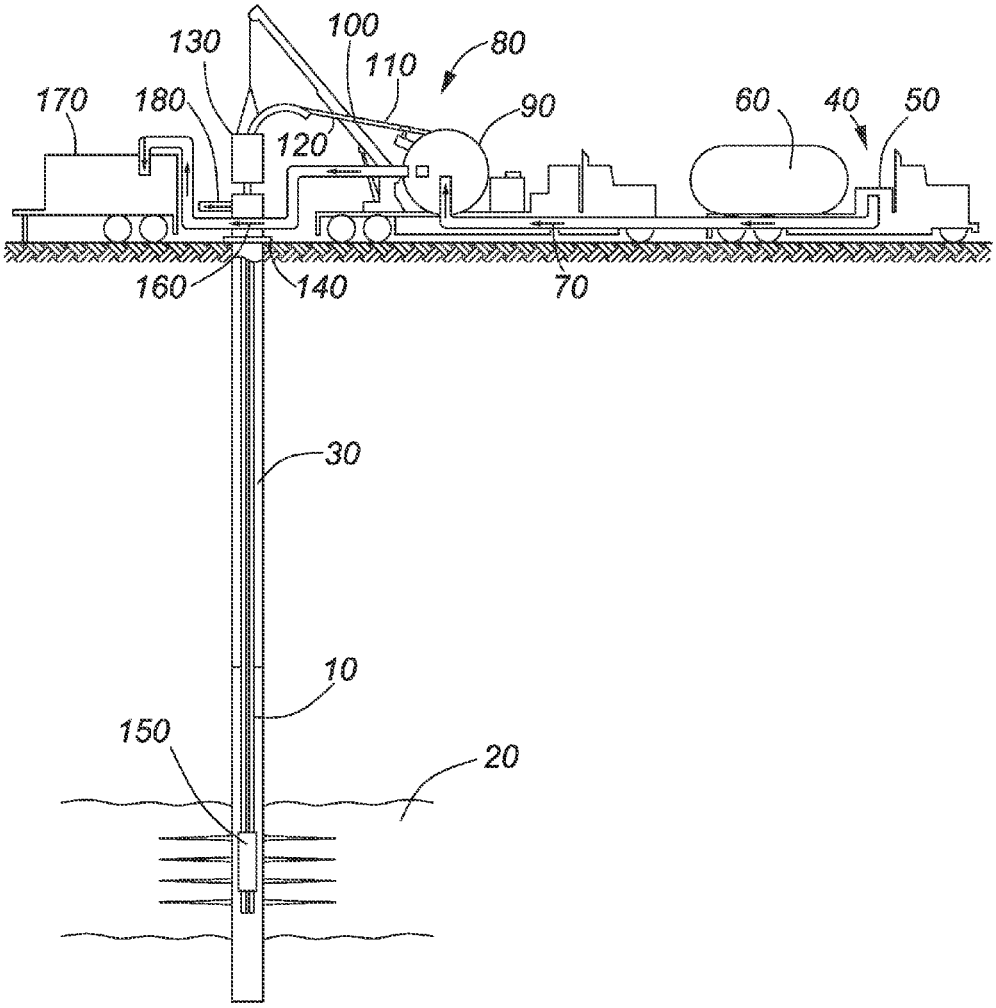
FIG. 1 is a schematic illustrating deployment of a jet pump and spoolable multi-string tubing system of the present invention.

FIG. 1 depicts a system including one embodiment of a multi-string tubing system and jet pump for removing wellbore fluid 10 from a subsurface or subterranean hydrocarbon bearing formation 20 via a wellbore 30. The wellbore fluid 10 may include entrained solids. A pressure pump truck 40 includes a surface pump 50 and a fluid storage tank 60. Power fluid 70 is conveyed to a coiled tubing unit 80. The power fluid 70 is typically either water- or hydrocarbon-based. The coiled tubing unit 80 includes a coiled tubing reel 90 with a spoolable multi-string tubing system (SMTS) 100. The SMTS 100 may include two or more conduits, for example a supply tubing string 110 and a return tubing string 120.

Power fluid 70 flows in the supply tubing string 110 of the SMTS 100. The SMTS 100 is deployed using a coiled tubing injector 130 with injector blocks adapted to run the SMTS 100. The SMTS 100 is positioned through a wellhead 140 and into the wellbore 30. The downhole end of the SMTS 100 includes a jet pump 150 powered by power fluid 70, which is deployed into the wellbore 30 to remove wellbore fluid 10. Inside the jet pump 150, wellbore fluid 10 is combined with the power fluid 70; this combination is return fluid 160.

Return fluid 160 is pumped to the surface via the return tubing string 120 in the SMTS 100. The return fluid 160 exits the coiled tubing reel 90 and is conveyed to a return tank 170. Any gas from the wellbore 30 flows into a gas line 180. The gas line 180 may be shut in or opened to gas flow during use of the jet pump 150.

Jet Pump

Figure 2:
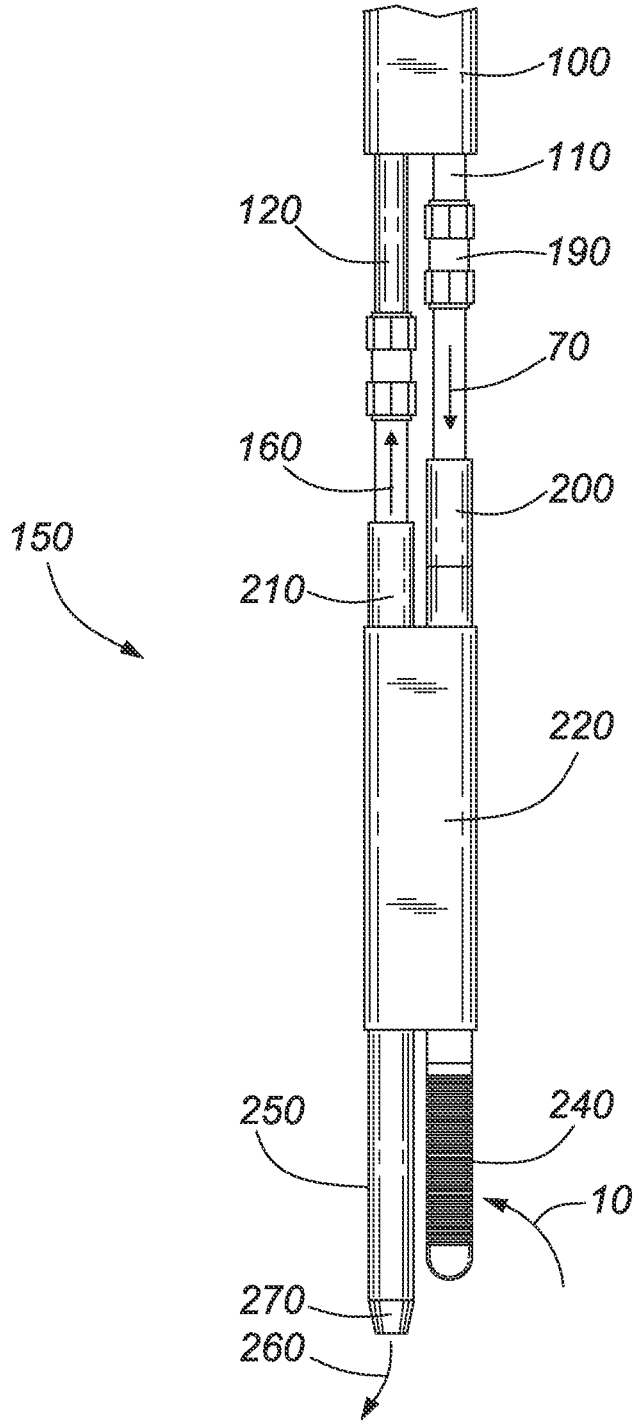
FIG. 2 is a jet pump of the present invention.
Figure 16:
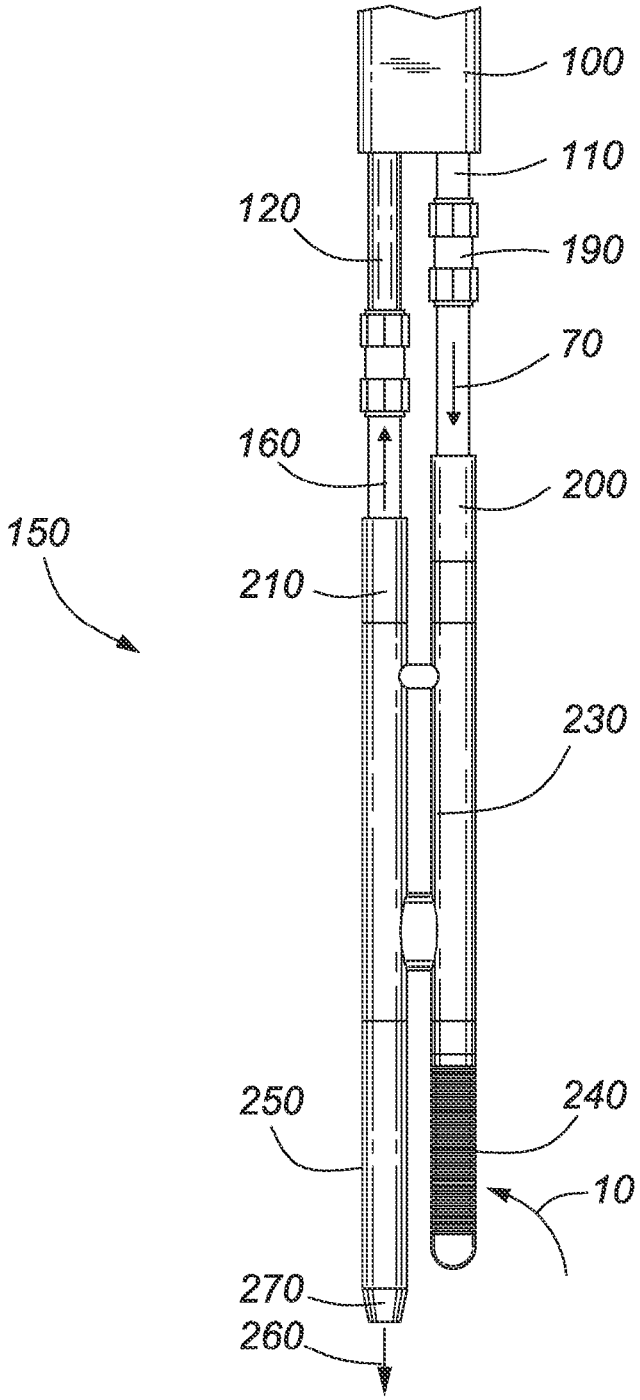
FIG. 16 is a jet pump of the present invention having a dual-barrel jet pump body.

FIG. 2 depicts an embodiment of a jet pump 150 for use with a SMTS 100 wherein the SMTS 100 includes a supply tubing string 110 and a return tubing string 120. Connectors 190 connect a power fluid inlet 200 and the supply tubing string 110, and a return fluid outlet 210 and the return tubing string 120. The connectors 190 may be threaded, welded, or otherwise adapted to connect the jet pump body 220 with the supply tubing string 110 and the return tubing string 120. The jet pump body 220 may, for example, have a unibody design (as illustrated), or be a dual barrel jet pump body 230 (FIG. 16).

Power fluid 70 flows through the power fluid inlet 200 into the jet pump body 220, causing wellbore fluid 10 to flow into the jet pump body 220 through a jet pump intake 240. Power fluid 70 and wellbore fluid 10 are combined as return fluid 160 in the jet pump body 220. The return fluid 160 flows from the jet pump body 220 and into the return fluid outlet 210.

The jet pump body 220 may be adapted to direct power fluid 70 or return fluid 160 to a jetting sub 250. The jetting sub has an uphole end 252 and a downhole end 254. Jetting fluid 260 flows out of a jetting nozzle 270 proximate the downhole end 254. Jetting fluid 260 is any fluid, for example power fluid 70 or return fluid 160, that flows to the jetting sub 250.

SMTS

Figure 3:
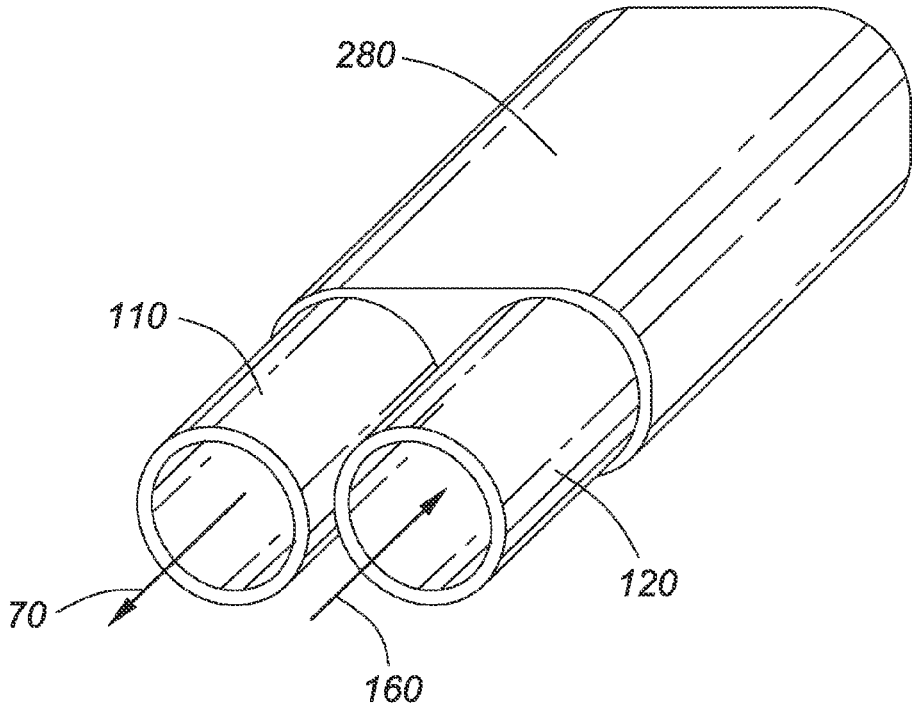
FIG. 3 is a multi-string tubing system for use with the jet pump of FIG. 2.

FIG. 3 depicts an embodiment of the SMTS 100 for use with the jet pump 150 of FIG. 2. The supply tubing string 110 and the return tubing string 120 are encapsulated in a single bundle 280 to facilitate deployment or retrieval with a single running operation using a conventional coiled tubing unit with modified injector chains. The supply tubing string 110 and the return tubing string 120 are substantially parallel with one another. As illustrated by FIG. 3, the supply tubing string 110 and the return tubing string 120 are laterally disposed with respect to one another. The tubing string 110 and the return tubing string 120 may abut along their long axes or, as illustrated in FIG. 3, may be positioned apart from one another.

Jet Pump Body

Figure 4:
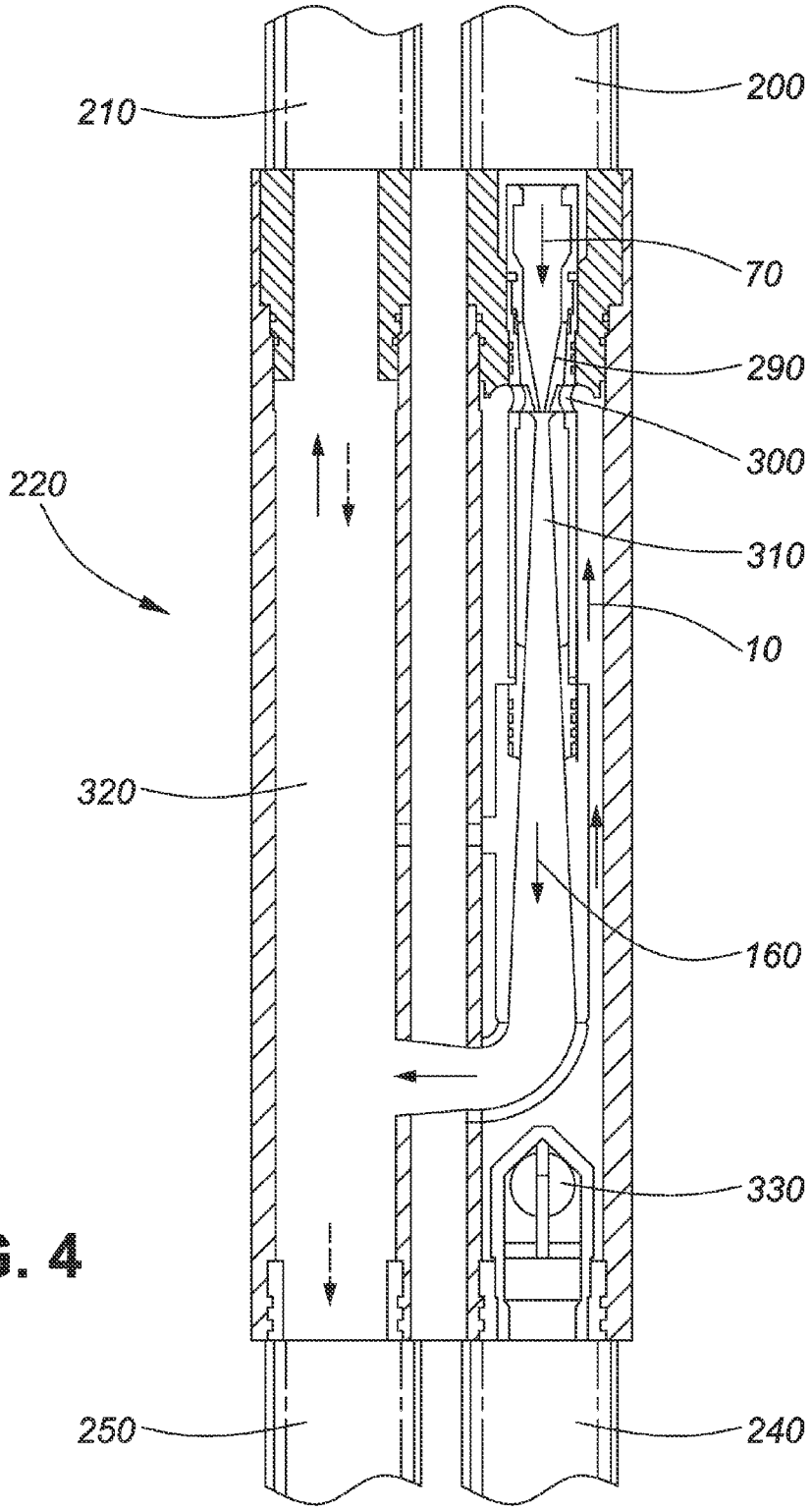
FIG. 4 is a cross section of one embodiment of a jet pump body of the jet pump of FIG. 2.

FIG. 4 is a cross-section of one embodiment of the jet pump body 220 of FIG. 2. Power fluid 70 flows into a venturi nozzle 290. While flowing through the venturi nozzle 290, the power fluid 70 flows past a venturi gap 300 between the venturi nozzle 290 and a diffuser 310, creating a low pressure condition at the venturi gap 300. The low pressure condition causes wellbore fluid 10 to flow into a jet pump intake 240 and to the venturi gap 300. Upon entering the venturi gap 300 and the diffuser 310, wellbore fluid 10 combines with power fluid 70, forming return fluid 160. At least a portion of the return fluid 160 flows through a return tube 320 and into a return fluid outlet 210. At least a portion of the return fluid 160 flows through the return tube 320 into the jetting sub 250. A check valve 330 may prevent backflow when flowing power fluid 70 is not flowing through the venturi nozzle 290, as may occur, for example, when the jet pump 150 (FIG. 2) is in a jetting mode (see FIG. 23).

Figure 5:
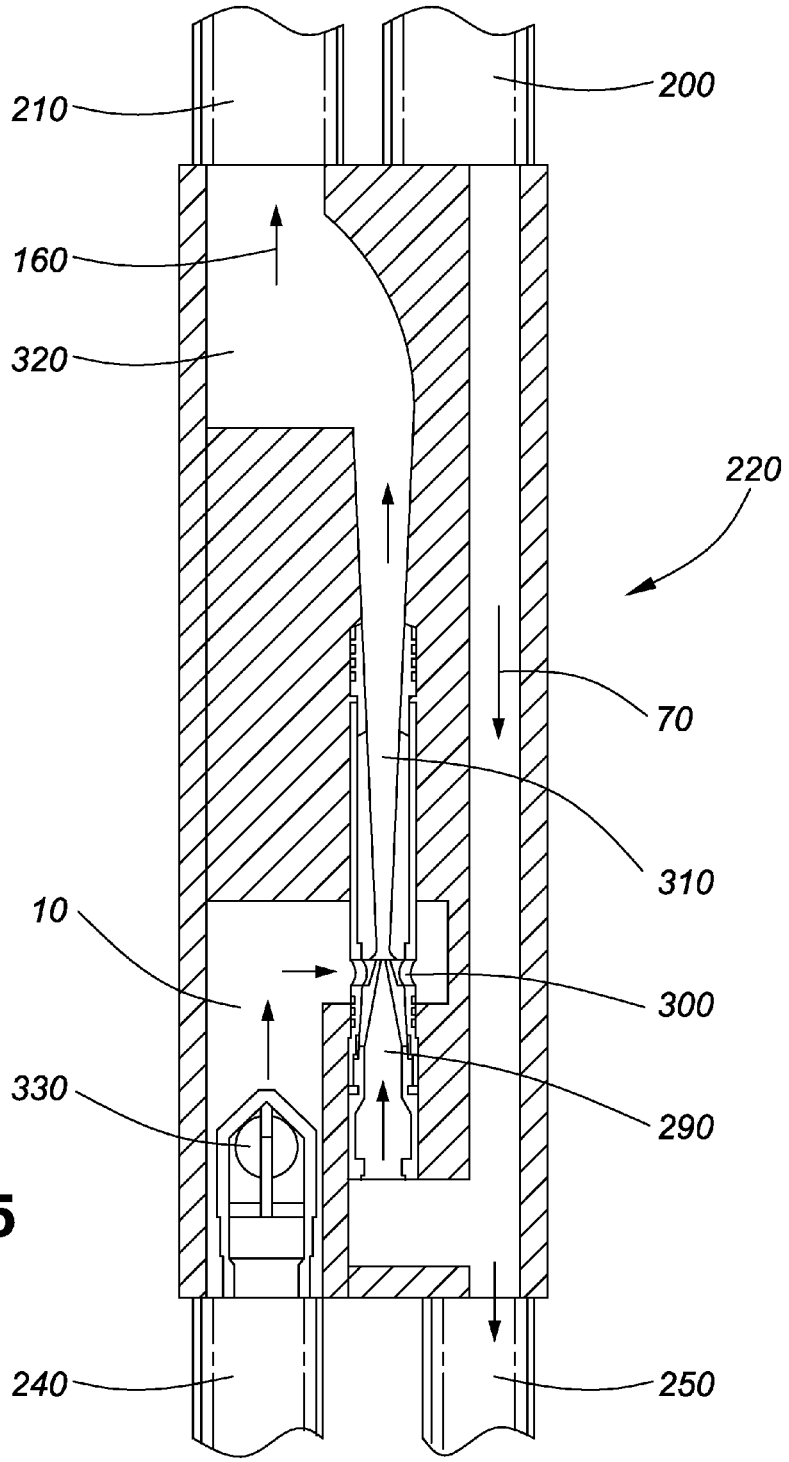
FIG. 5 is a cross section of a further embodiment of a jet pump body of the jet pump of FIG. 2.

FIG. 5 is a cross-section one embodiment of the jet pump body 220 of FIG. 2 wherein at least a portion of the power fluid 70 is directed to a jetting sub 250 from the power fluid inlet 200.

Figure 6:
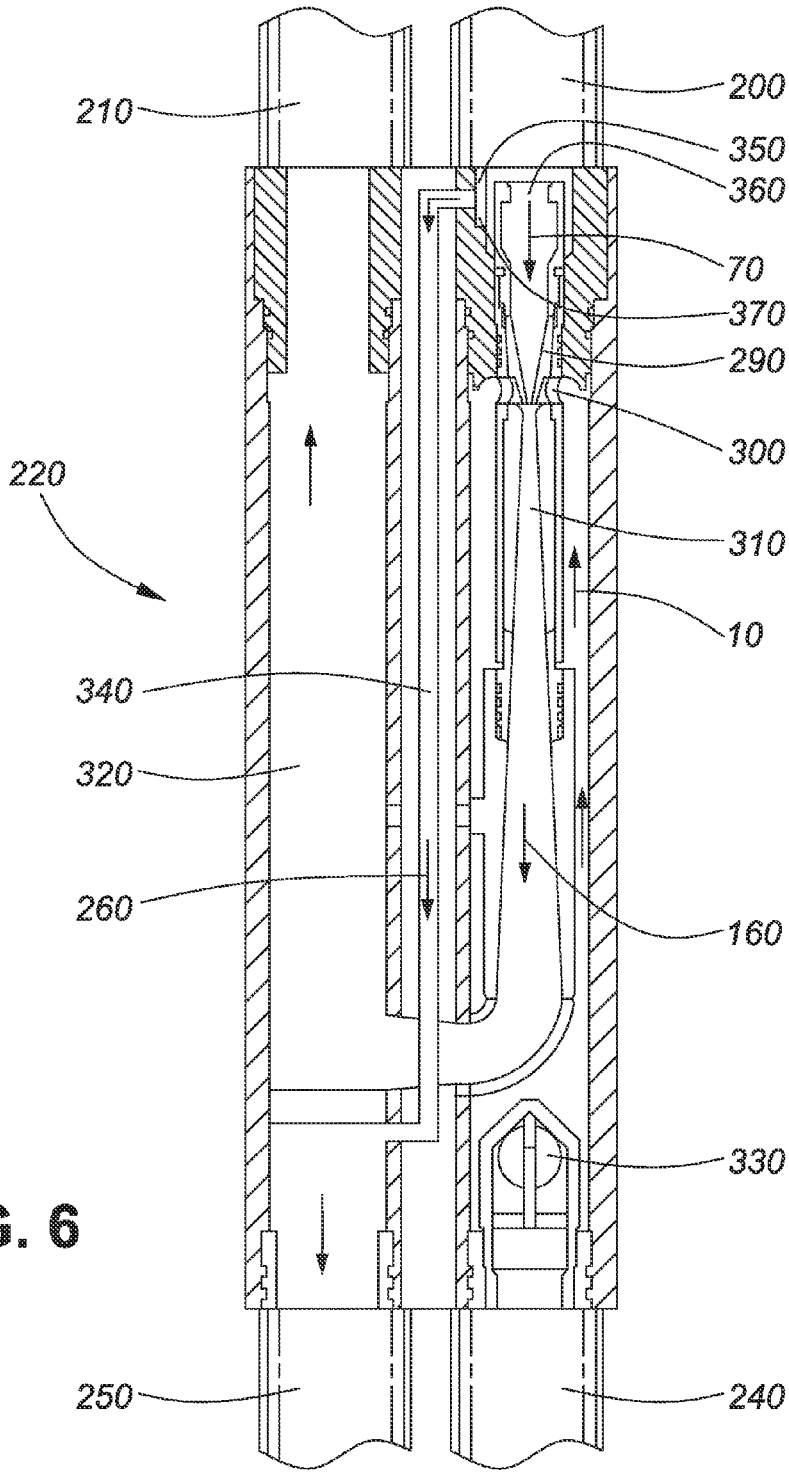
FIG. 6 is a cross section of a further embodiment of a jet pump body of the jet pump of FIG. 2.

FIG. 6 is a cross-section of one embodiment of the jet pump body 220 of FIG. 2 wherein at least a portion of the power fluid 70 flows along a jetting flow passage 340. A jetting inlet 350 to the jetting flow passage 340 is situated in the venturi inlet 360 upstream of the venturi nozzle 290 and includes a particulate screen 370. The jetting sub 250 is in fluid communication with the jetting flow passage 340.

Jet Pump with Auxiliary Tubing String

Figure 7:
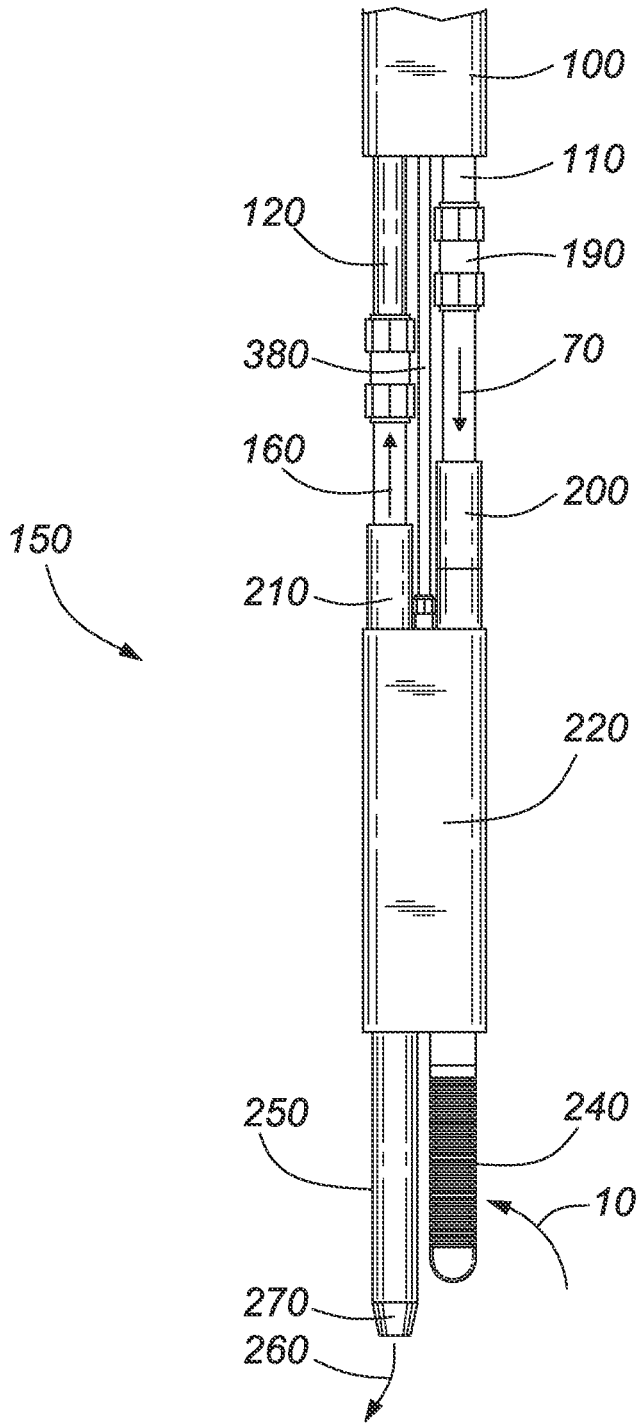
FIG. 7 is a jet pump of the present invention having an auxiliary tubing string.
Figure 8:
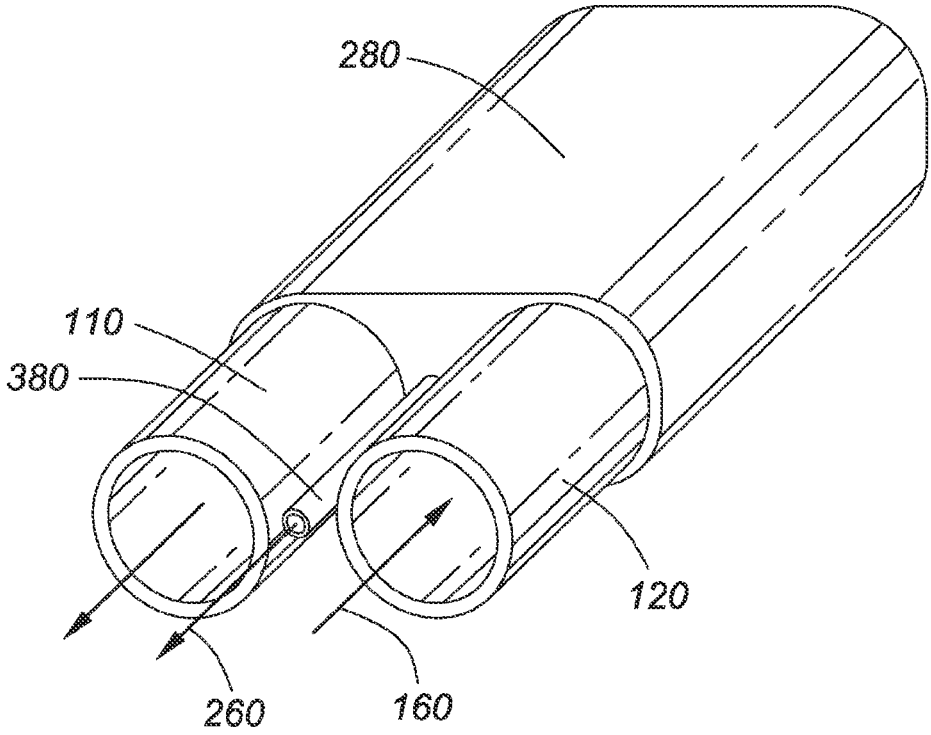
FIG. 8 is a multi-string tubing system for use with the jet pump of FIG. 7.

FIGS. 7 and 8 depict an embodiment of a jet pump 150 for use with a SMTS 100 wherein the SMTS 100 includes an auxiliary tubing string 380. A supply tubing string 110, a return tubing string 120, and the auxiliary tubing string 380 are encapsulated in a single bundle 280. The supply tubing string 110, the return tubing string 120, and the auxiliary tubing string 380 are all substantially parallel with, and laterally disposed with respect to, one another. A jetting sub 250 is in fluid communication with the auxiliary tubing string 380. Jetting fluid 260 flows from the auxiliary tubing string 380 to the jetting sub 250.

Figure 9:
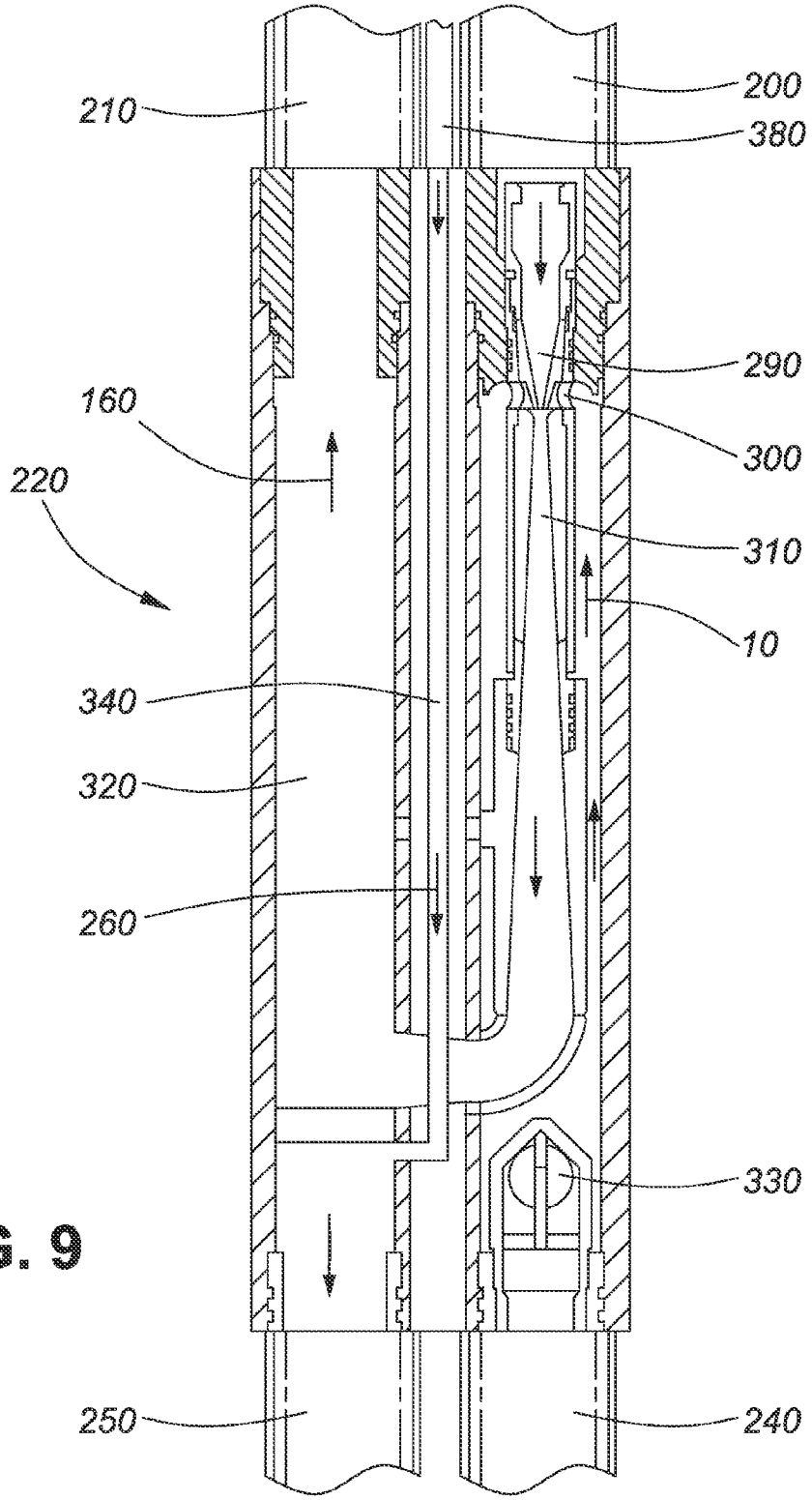
FIG. 9 is a cross section of a jet pump body of the jet pump of FIG. 7.

FIG. 9 is a cross-section of the jet pump body 220 of FIG. 7 wherein an auxiliary tubing string 380 is in fluid communication with a jetting flow passage 340 through which jetting fluid 260 flows to the jetting sub 250.

Jet Pump with Data-Sensing Sub

Figure 10:
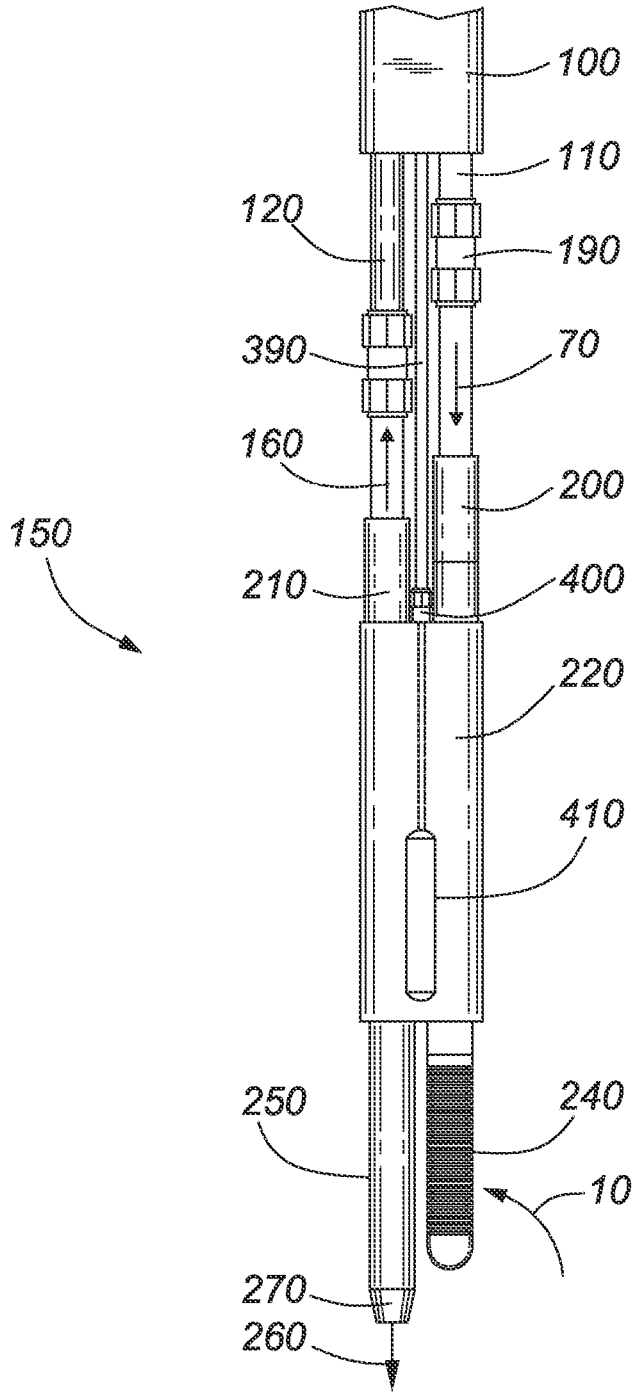
FIG. 10 is a jet pump of the present invention having a data-sensing sub.
Figure 11:
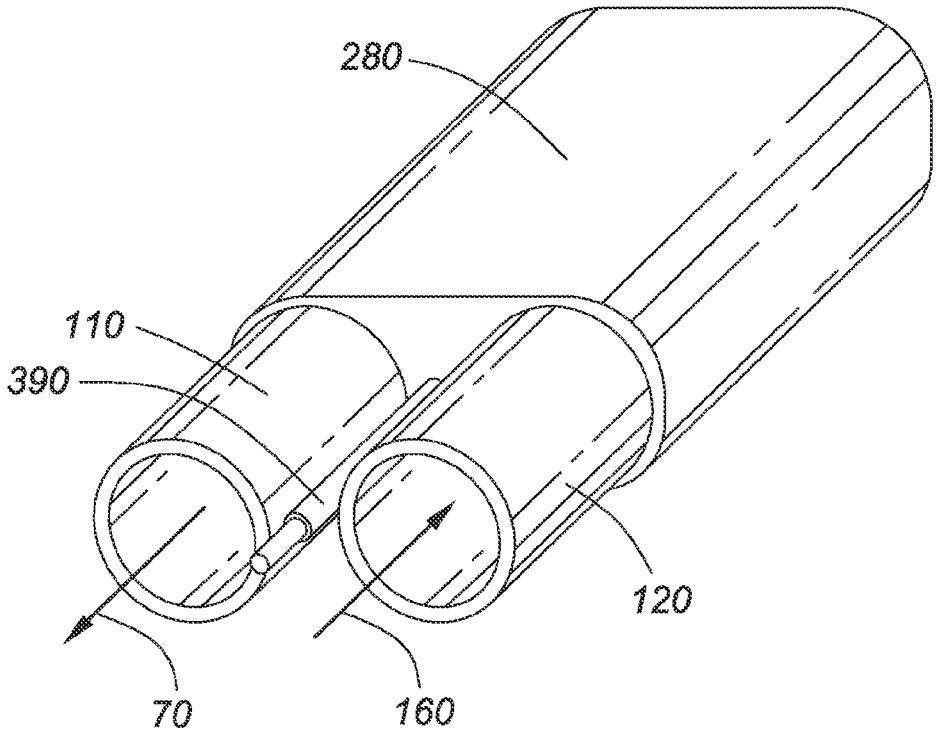
FIG. 11 is a multi-string tubing system for use with the jet pump of FIG. 10.

FIGS. 10 and 11 depict an embodiment of a jet pump 150 for use with a SMTS 100 wherein the SMTS 100 includes a communications line 390. A supply tubing string 110, a return tubing string 120, and the communications line 390 are encapsulated in a single bundle 280. The supply tubing string 110, the return tubing string 120, and the communications line 390 are all substantially parallel with, and laterally disposed with respect to, one another. The communications line 390 may be a small tubing string or an electrical conductor, include, for example, hydraulic, electric, or fiber optic communication means. A communications connector 400 operatively connects a data-sensing sub 410 with the communications line 390. The communications connector 400 may be threaded, welded, or otherwise adapted to operatively connect the data-sensing sub 410 with the communications line 390. When data such as bottomhole pressure, temperature, or both are required, data from the data-sensing sub 410 is received at the surface electronically or through pressure communication. Examples of data that the data-sensing sub 410 may be adapted to receive include temperature and pressure.

Jet Pump with Jetting Flow Valve

Figure 12:
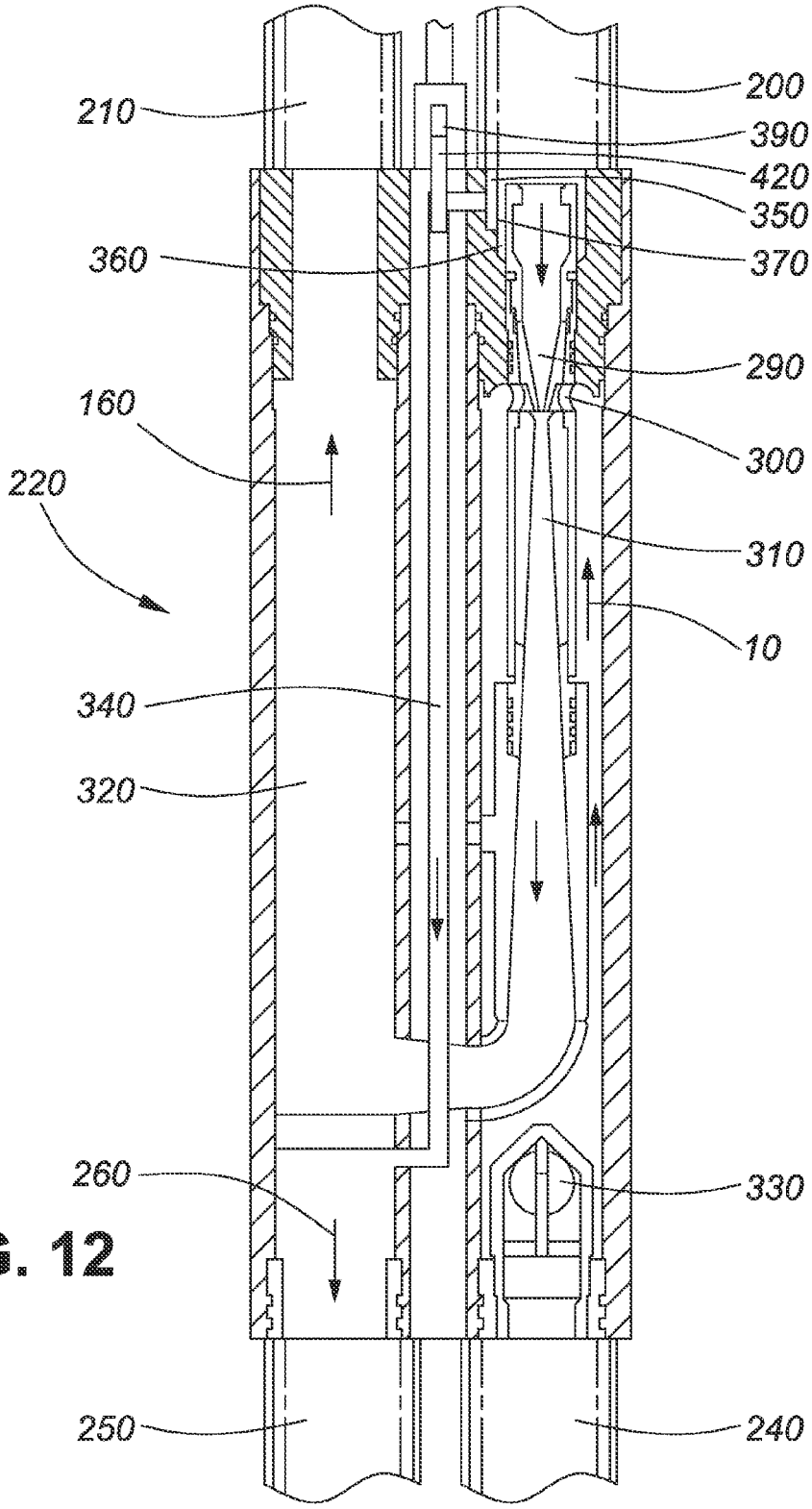
FIG. 12 is a cross section of a jet pump body of the present invention having a jetting flow valve.

FIG. 12 is a cross-section of a jet pump body 220 wherein power fluid 70 enters the jet pump body 220 through the power fluid inlet 200. At least a portion of the power fluid 70 flows along a jetting flow passage 340 (wherein it is referred to as jetting fluid 260). A jetting flow valve 420 is located along the jetting flow passage 340 and is adapted to selectively obstruct flow of the jetting fluid 260 through the jetting flow passage 340. The jetting flow valve 420 is operatively connected with a communications line 390. Subject to the state of the jetting flow valve 420, the jetting flow passage 340 provides fluid communication between a power fluid inlet 200 and the jetting sub 250.

Jet Pump with Jetting Flow Valve and Data-Sensing Sub

Figure 13:
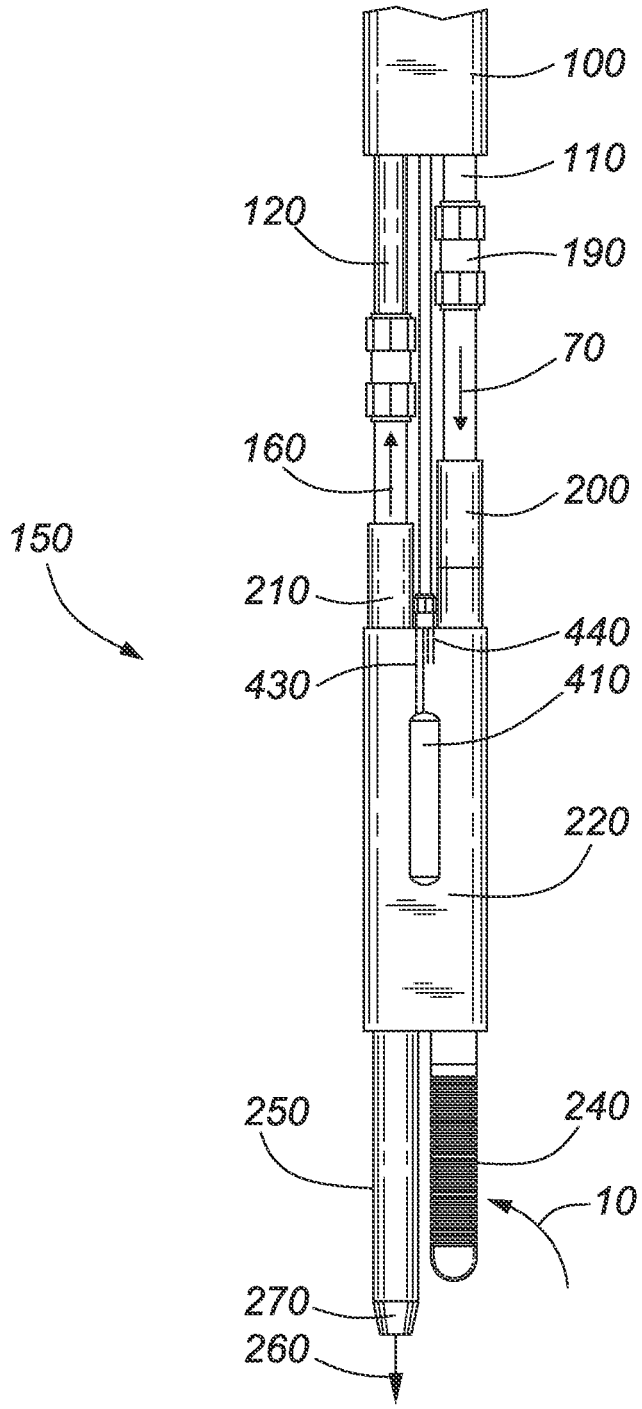
FIG. 13 is a jet pump of the present invention having a first communications line and a second communications line.
Figure 14:
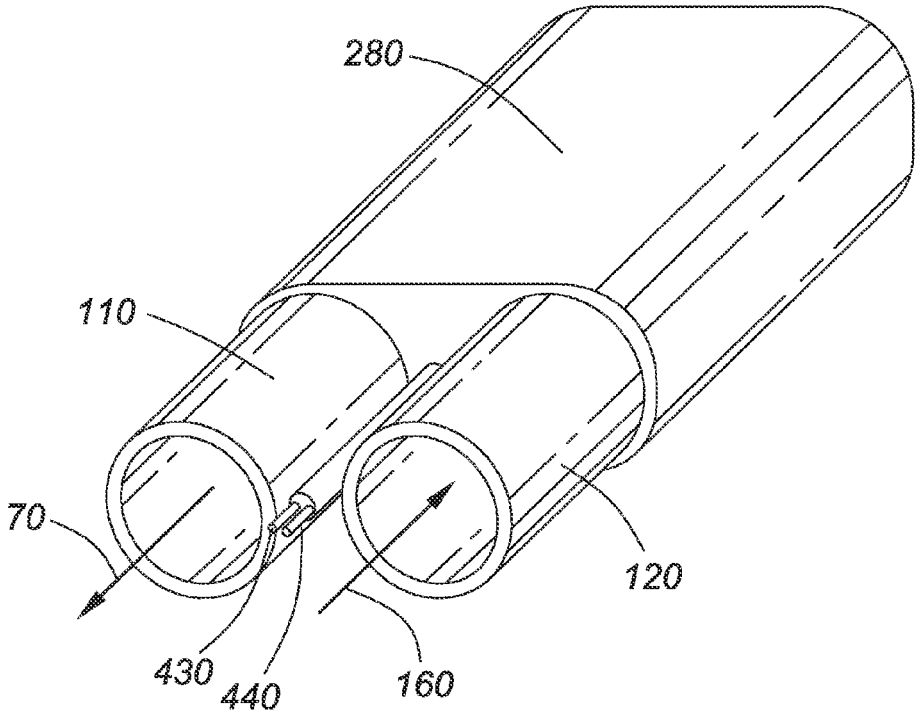
FIG. 14 is a multi-string tubing system for use with the jet pump of FIG. 13.
Figure 15:
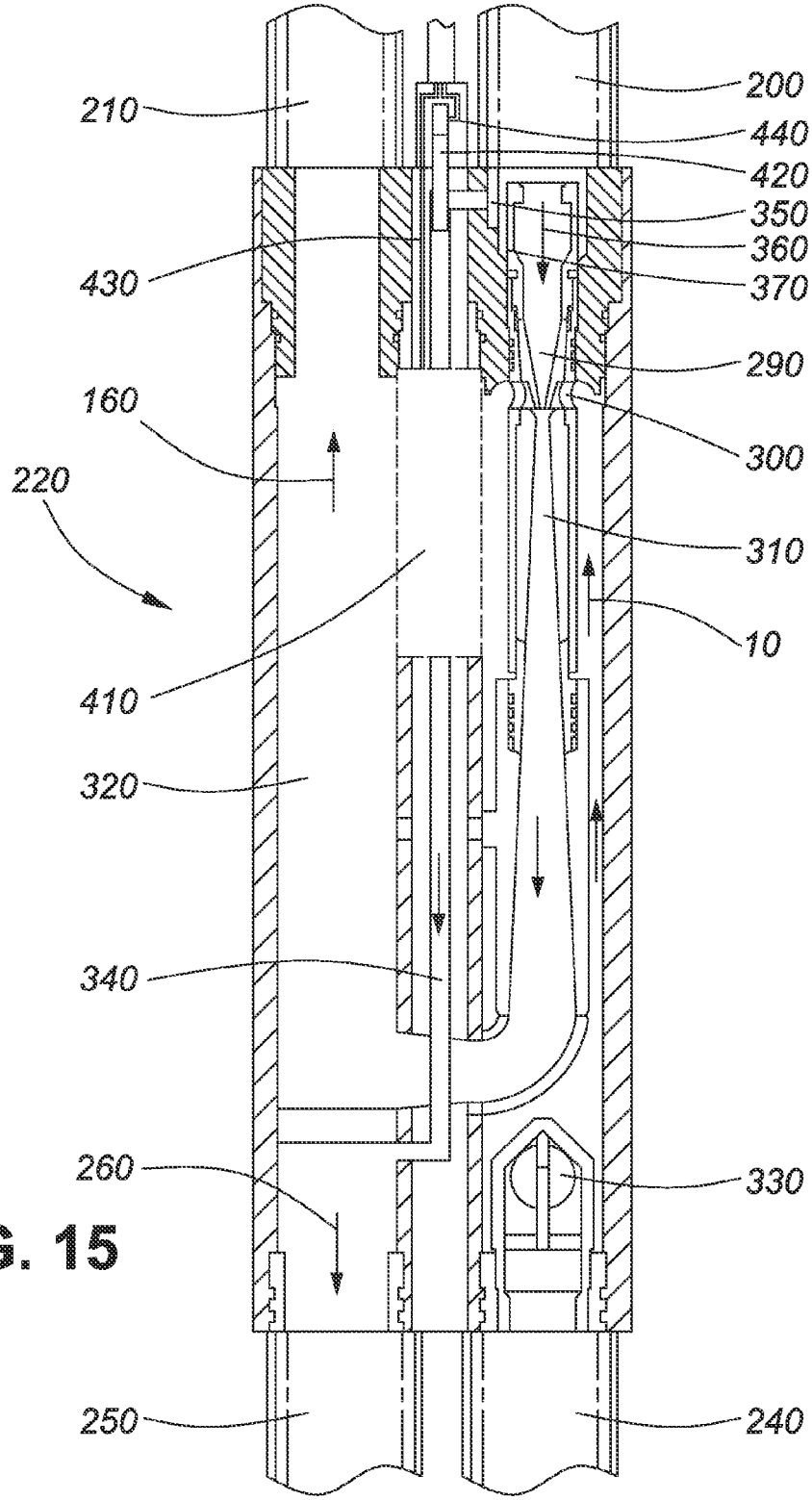
FIG. 15 is a cross section of a jet pump body of the jet pump of FIG. 13.

FIGS. 13, 14, and 15 depict an embodiment of a jet pump 150 for use with a SMTS 100 wherein the SMTS 100 includes a first communications line 430 and a second communications line 440. A supply tubing string 110, a return tubing string 120, the first communications line 430, and the second communications line 440 are encapsulated in a single bundle 280. The supply tubing string 110, the return tubing string 120, the first communications line 430, and the second communications line 440 are all substantially parallel with one another. The first communications line 430 and the second communications line 440 may each be a small tubing string or an electrical conductor, include, for example, hydraulic, electric, or fiber optic communication means. A data-sensing sub 410 is operatively connected with the first communications line 430. A jetting flow valve 420 is operatively connected with the second communications line 440.

Dual-Barrel Jet Pump Body

FIG. 16 is an embodiment of a jet pump 150 including a dual-barrel jet pump body 230. Internally, the dual-barrel jet pump body 230 functions in a similar manner to a jet pump body 220 (FIG. 2) with a unibody design.

Jetting Sub

Figure 17:
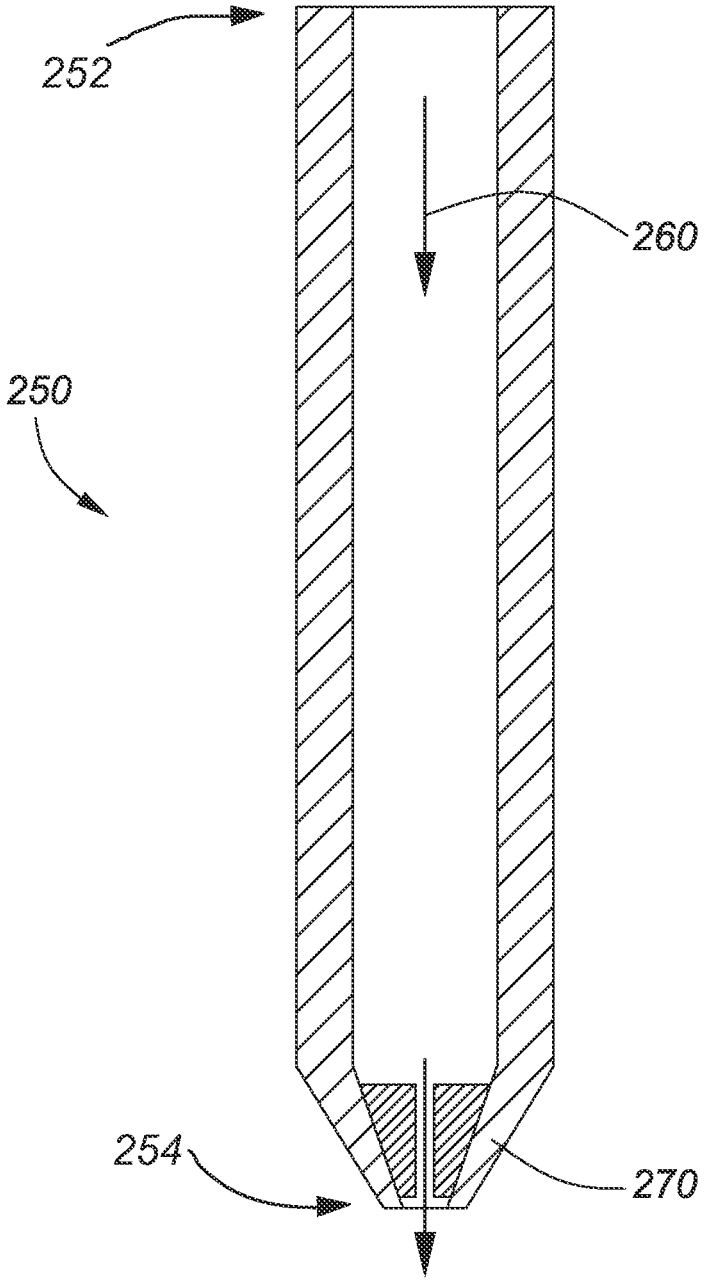
FIG. 17 is a jetting sub of the present invention.

FIG. 17 depicts a jetting sub 250 for a jet pump 150 (FIG. 2), with a jetting nozzle 270. Jetting fluid 260 flows from a jet pump body 220, through the jetting sub 250, and out the jetting nozzle 270.

Figure 18:
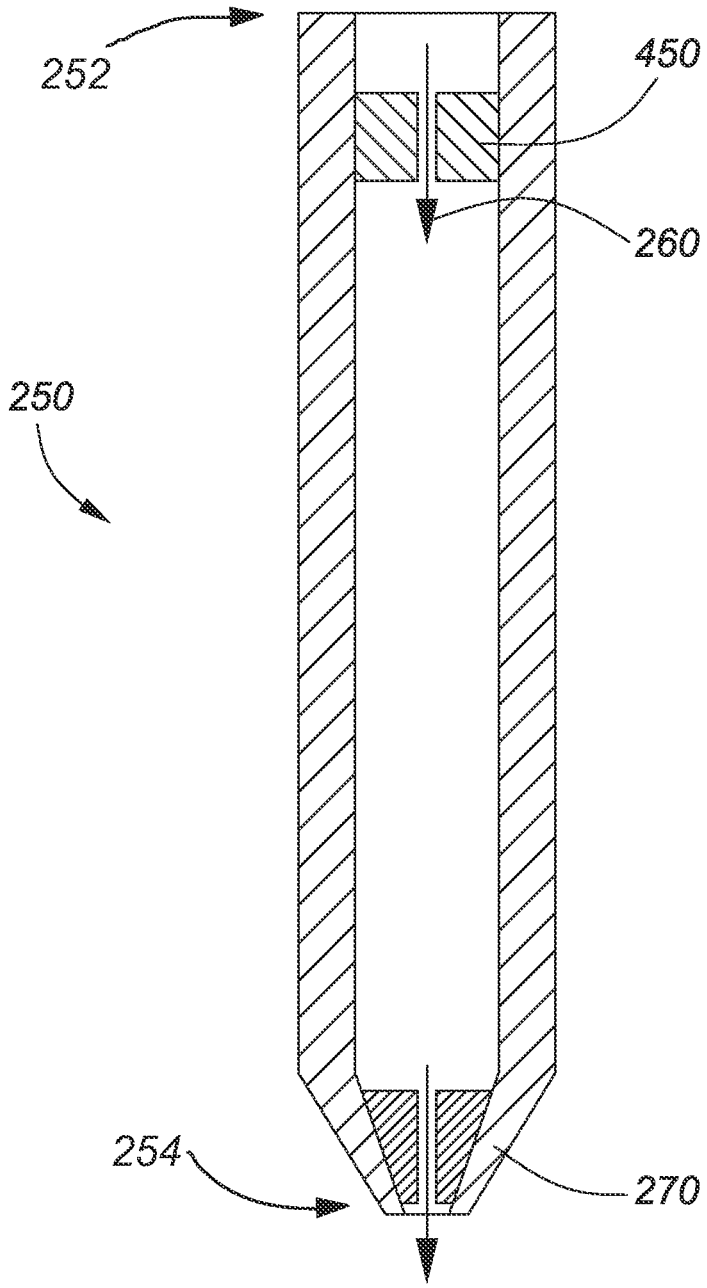
FIG. 18 is a jetting sub of the present invention having a flow control choke.

FIG. 18 depicts a jetting sub 250 for a jet pump 150 (FIG. 2), having an upper flow control choke 450 proximate the uphole end 252. The upper flow control choke 450 is sized to limit flow of jetting fluid 260 that may otherwise occur if the jetting nozzle 270 washes out, for example due to sand erosion.

Figure 19:
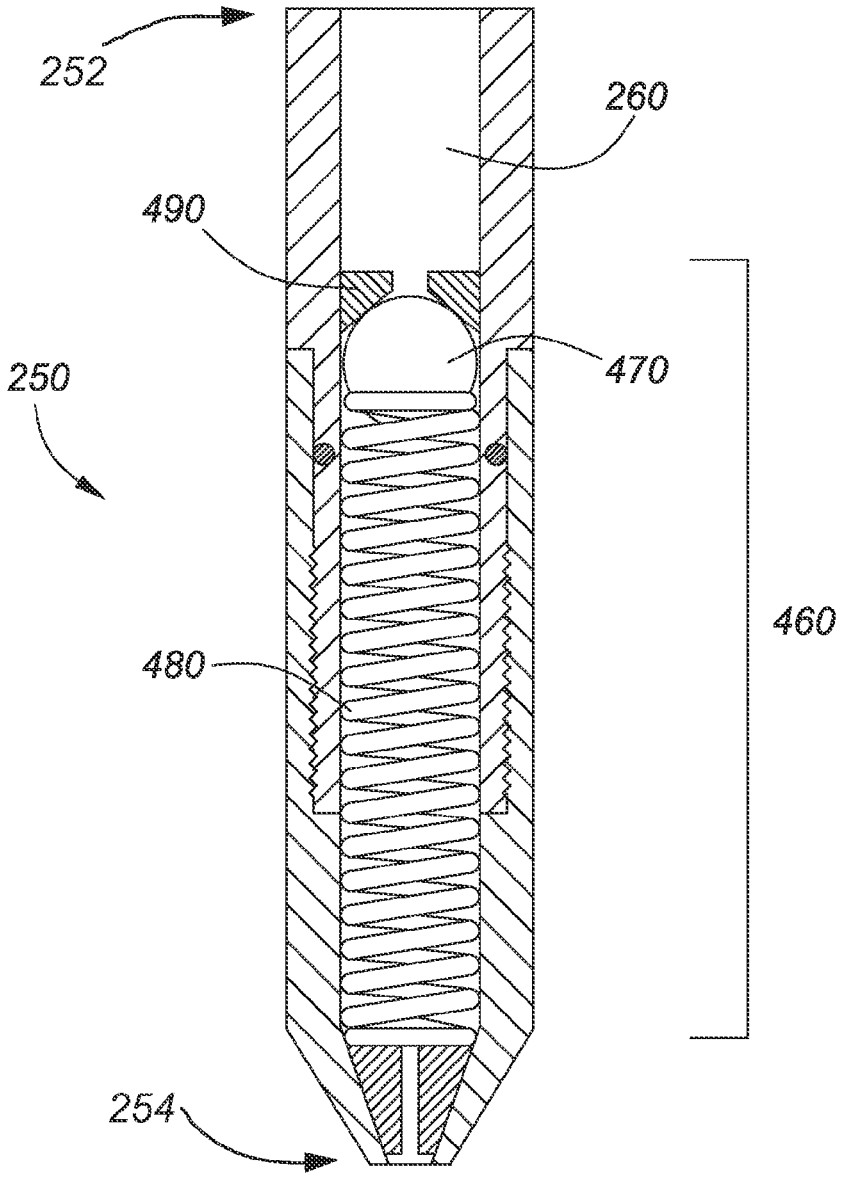
FIG. 19 is a jetting sub of the present invention having a back-pressure valve.

FIG. 19 depicts a jetting sub 250 for a jet pump 150 (FIG. 2) wherein access by jetting fluid 260 to the jetting nozzle 270 is subject to a back-pressure valve 460. The back-pressure valve 460 may include, for example, a ball 470, a spring 480, and a seat 490. The back-pressure valve 460 may be adapted to open at a selected back-pressure setting. The back-pressure setting is selected by selecting a spring rate, distance, or combination thereof, of the spring 480. When fluid pressure equal to or greater than the back-pressure setting is applied, the spring 480 is compressed and jetting fluid 260 flows through the jetting nozzle 270.

Jetting Nozzle

Figure 20:
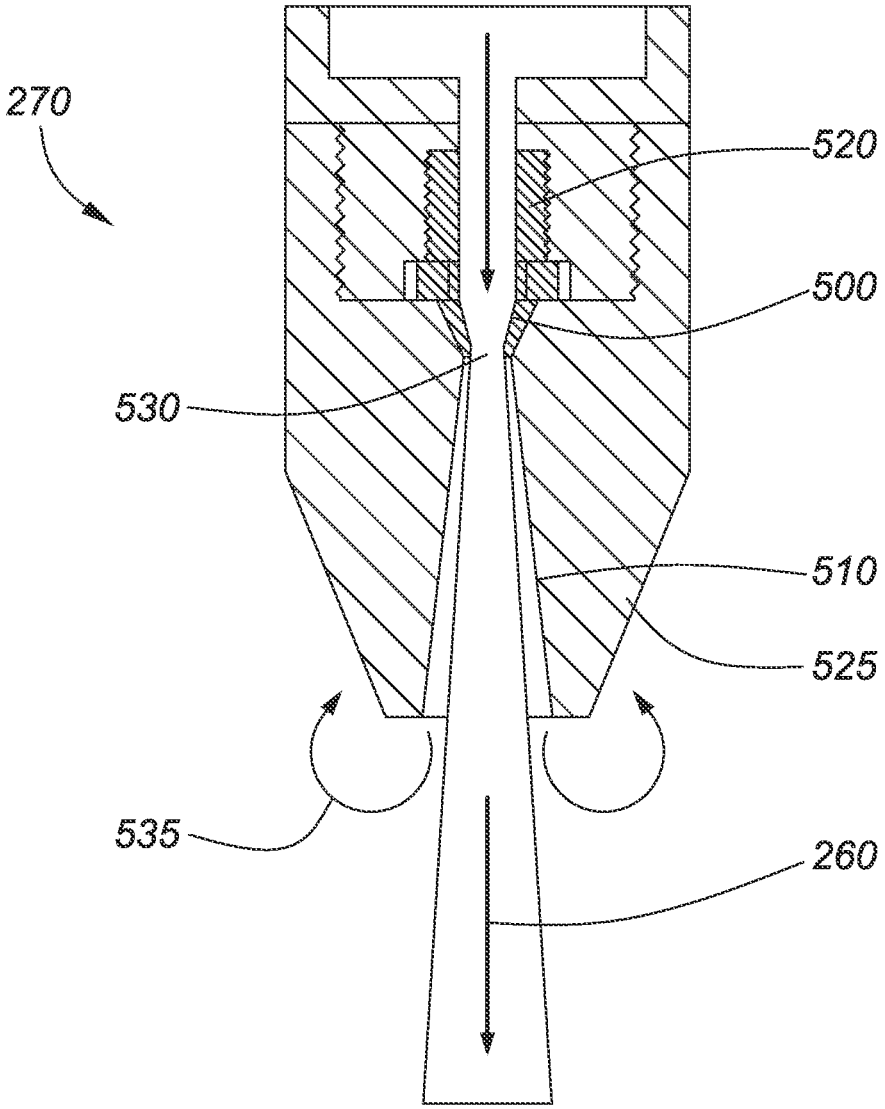
FIG. 20 is one embodiment of a jetting nozzle of the present invention.

FIG. 20 depicts a jetting nozzle 270 for a jetting sub 250 wherein jetting fluid 260 flows through a converging jetting passage 500 and a diverging jetting passage 510. The converging jetting passage 500 may be present on a converging jetting passage insert 520. The diverging jetting passage 510 may be present on a disposable nose 525. Each of the converging jetting passage insert 520 and the disposable nose 525 may be reversibly connected with the jetting nozzle 270, for example by a threaded connection. The converging jetting passage 500 and the diverging jetting passage 510 form a jetting pinch 530. The jetting pinch 530 is sized to provide back-pressure for the jetting nozzle 270. When jetting fluid 260 flows from the jetting nozzle 270, particulates 535, for example from a wellbore obstruction 570 (FIG. 23), may eddy in proximity to the jetting nozzle 270. Particulates 535 eddy in proximity to the diverging jetting passage 510 preferentially to the converging jetting passage 500 and the jetting pinch 530, protecting the converging jetting passage 500 and the jetting pinch 530 from damage. If the disposable nose 525 is damaged by the particulates 535, it may be replaced.

Figure 21:
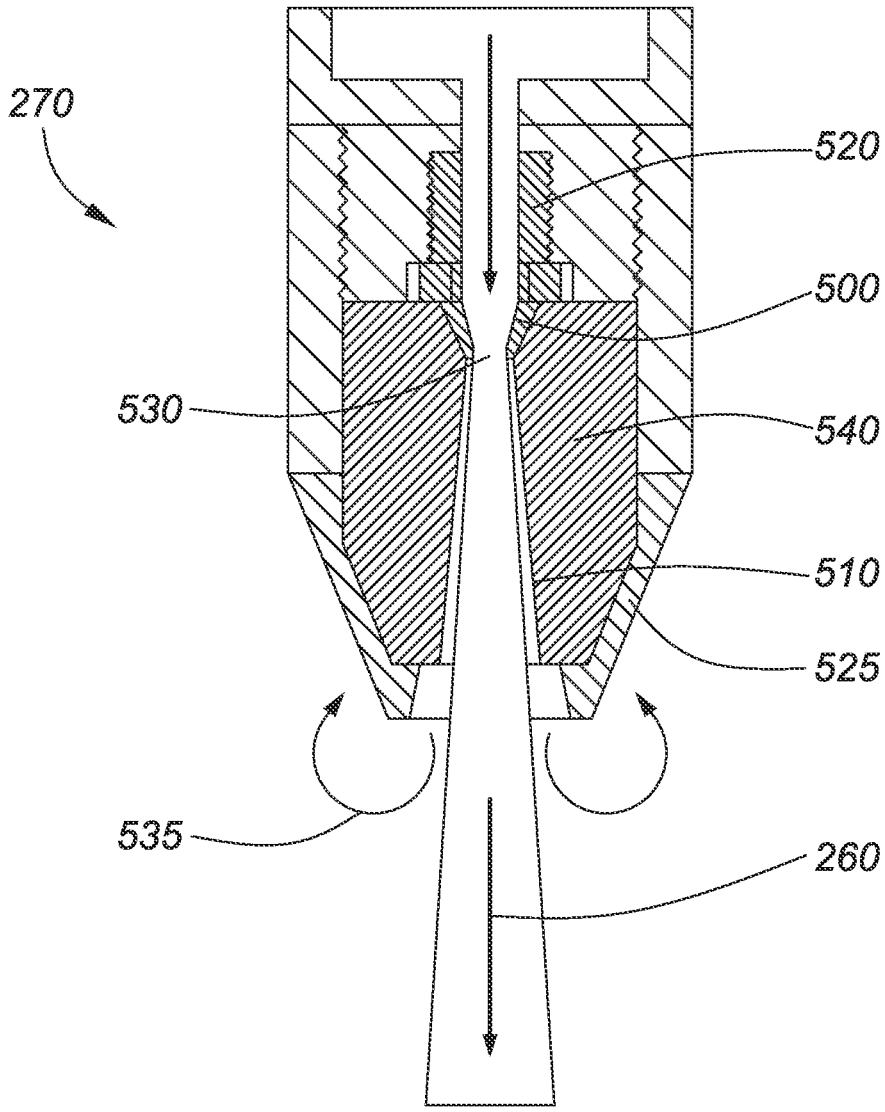
FIG. 21 is a further embodiment of the jetting nozzle of FIG. 20.

FIG. 21 depicts a jetting nozzle 270 for a jetting sub 250, wherein an abrasion-resistant elastomeric insert 540 is located radially outward from the diverging jetting passage 510. The abrasion-resistant elastomeric insert 540 is more resistant to damage caused by particulates than the diverging jetting passage 510.

Jet Pump Intake

Figure 22:
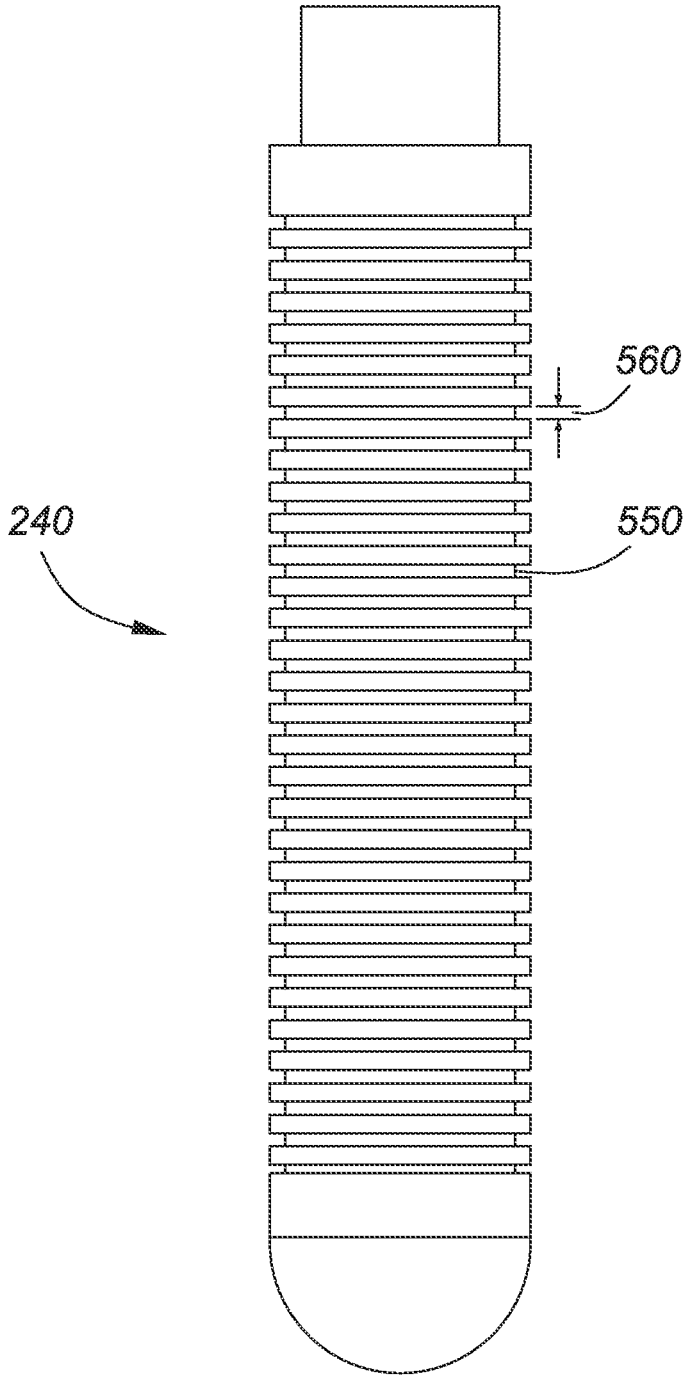
FIG. 22 is a jet pump intake of the present invention.

FIG. 22 depicts a jet pump intake 240 for a jet pump 150, which includes slots 550. An opening dimension 560 of the slots 550 is selected based on the size of a venturi gap 300 in the jet pump body 220 (FIG. 4) and the size of any material in the wellbore 30 which may enter the jet pump intake 240. The opening dimension 560 is selected to be large enough to admit most particulates that will be found in a wellbore 30 but small enough to prevent intake of particulates that are large enough to plug the venturi gap 300.

Method of Using a Jet Pump

Figure 23:
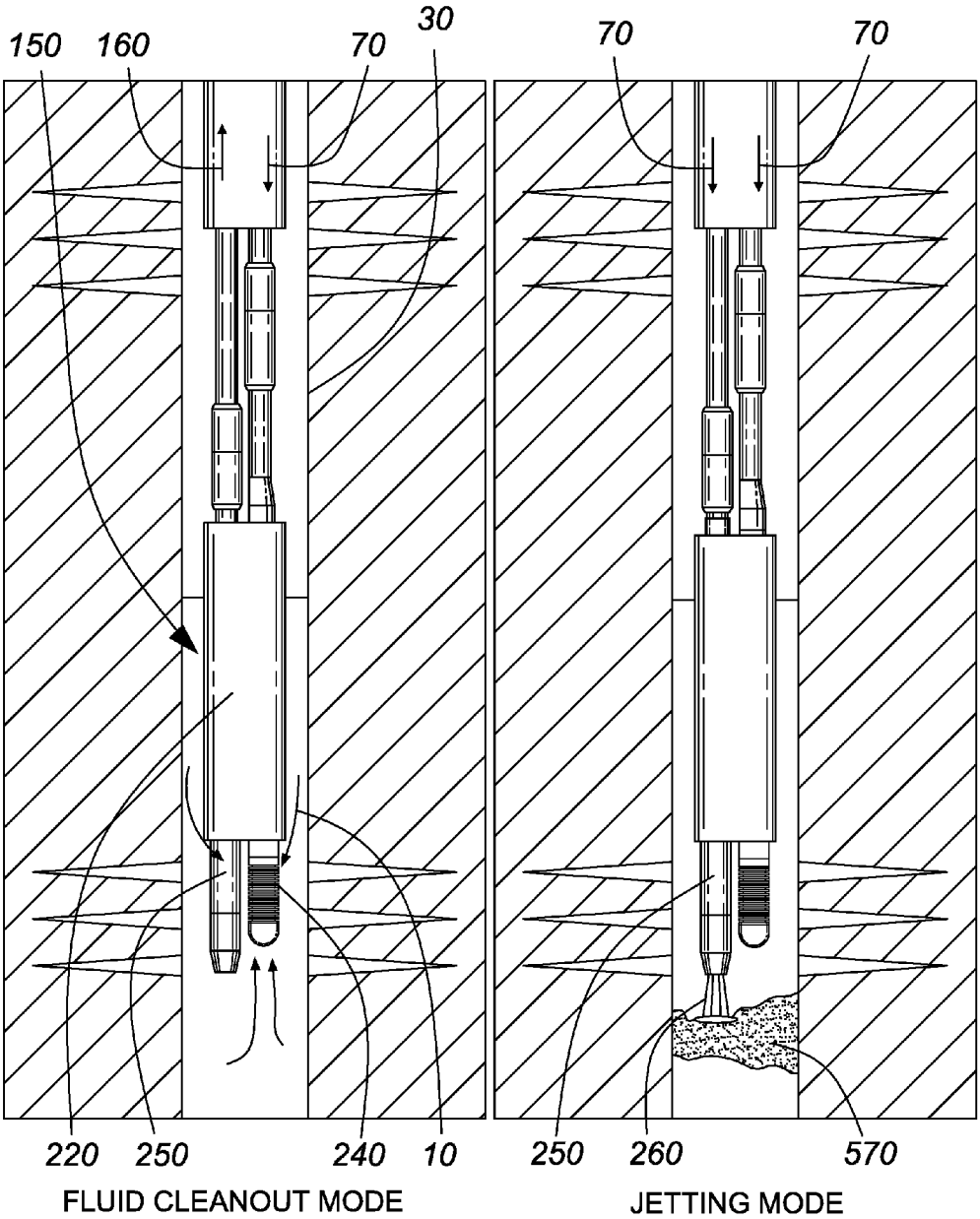
FIG. 23 depicts a method of the present invention of using one embodiment of a jet pump and multi-string tubing system to sequentially remove wellbore fluid and eliminate obstructions from the wellbore.

FIG. 23 illustrates one embodiment of a method of using a jet pump 150. The jet pump 150 includes a jet pump body 220, a jetting sub 250 and a jet pump intake 240. The jetting sub 250 includes a jetting nozzle 270. Wellbore fluid 10 may be pumped to the surface by the jet pump 150 (fluid cleanout mode). If a wellbore obstruction 570 (for example a sand bridge) is present, suction at the jet pump intake 240 may cease and jetting fluid 260 may be emitted from the jetting nozzle 270 to disperse the wellbore obstruction 570 (jetting mode). Once the wellbore obstruction 570 is sufficiently dispersed, emission of jetting fluid 260 from the jetting nozzle 270 may cease and pumping of wellbore fluid 10 to the surface by the jet pump 150 may be resumed.

Changing from the fluid cleanout mode to the jetting mode may be accomplished by reconfiguring a return tubing string 120 such that power fluid 70 is supplied to the jet pump body 220 through both a supply tubing string 110 and the return tubing string 120. The same change may be accomplished by blocking the return tubing string 120. Changing from the jetting mode to the fluid cleanout mode may be accomplished by reconfiguring the return tubing string 120 to remove return fluid 160. A jet pump 150 having a jet pump body 220, for example, as in FIG. 4, or as in FIG. 5 wherein the jetting sub 250 includes a back-pressure valve 460 (FIG. 19), is suitable for use in the method of FIG. 23.

Figure 24:
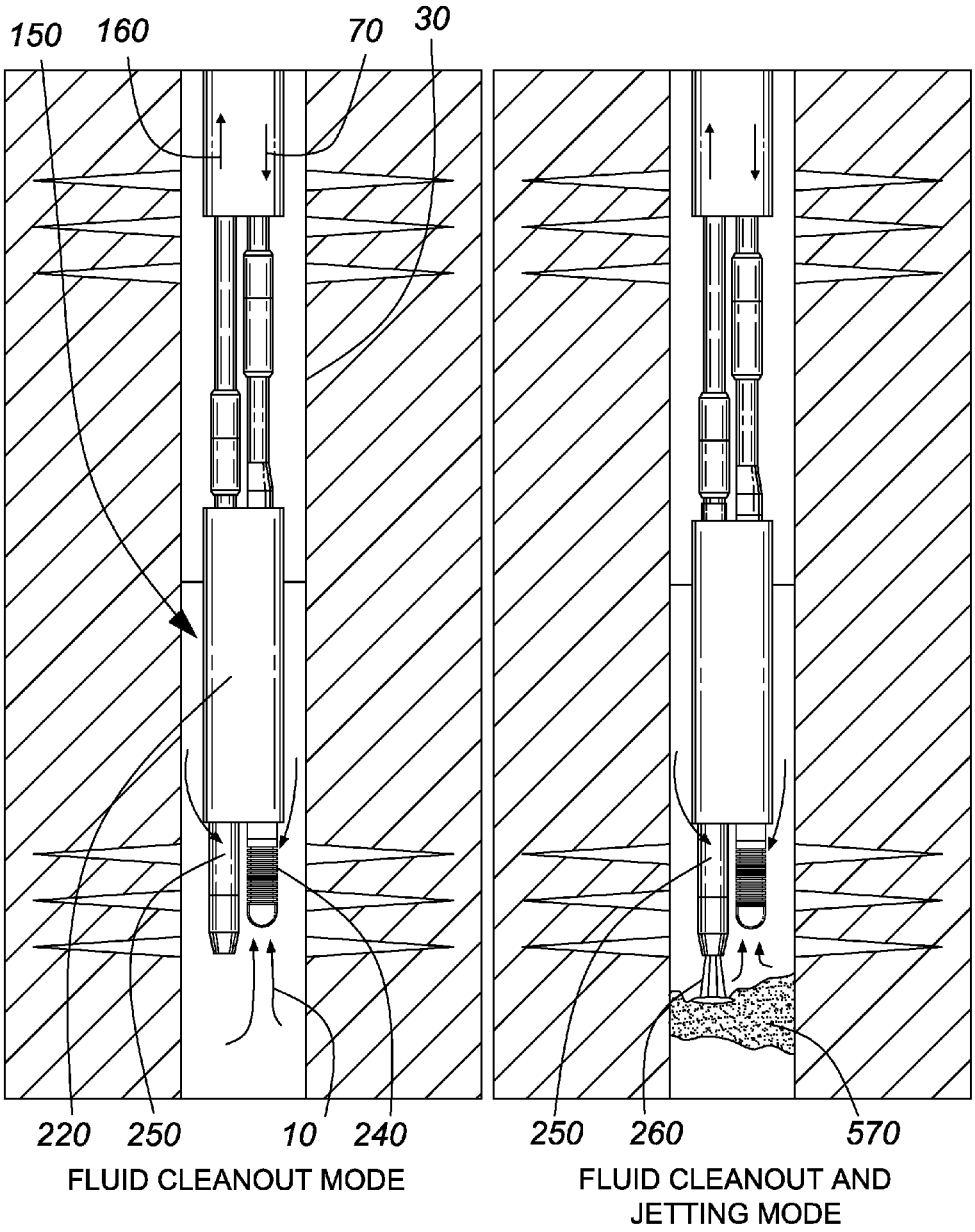
FIG. 24 depicts a method of the present invention of using the jet pump and multi-string tubing system of FIG. 23 to sequentially remove wellbore fluid, and simultaneously remove wellbore fluid and eliminate obstructions from the wellbore.

FIG. 24 illustrates a further embodiment of a method of using the jet pump 150 of FIG. 23. Wellbore fluid 10 may be pumped to the surface by the jet pump 150 (fluid cleanout mode). If a wellbore obstruction 570 (for example a sand bridge) is present, jetting fluid 260 may be emitted from the jetting nozzle 270 to disperse the wellbore obstruction 570 (jetting and fluid cleanout mode). Once the wellbore obstruction 570 is sufficiently dispersed, emission of jetting fluid 260 from the jetting nozzle 270 may cease.

Where the jet pump 150 includes a jet pump body 220 configured, for example, as in FIG. 5 and wherein the jetting sub 250 includes a back-pressure valve 460 as in FIG. 19, changing from the fluid cleanout mode to the jetting and fluid cleanout mode may be accomplished by supplying power fluid 70 from a supply tubing string 110 at a selected fluid pressure, the selected fluid pressure being sufficient to compress a spring 480 (FIG. 19), allowing jetting fluid 260 to flow through the jetting nozzle 270. Changing from jetting and fluid cleanout mode to the fluid cleanout mode may be accomplished by lowering the fluid pressure at which power fluid 70 is supplied from a supply tubing string 110 below a back-pressure setting of the spring 480, such that the spring 480 is no longer compressed, and jetting fluid 260 is prevented from flowing through the jetting nozzle 270.

Figure 25:
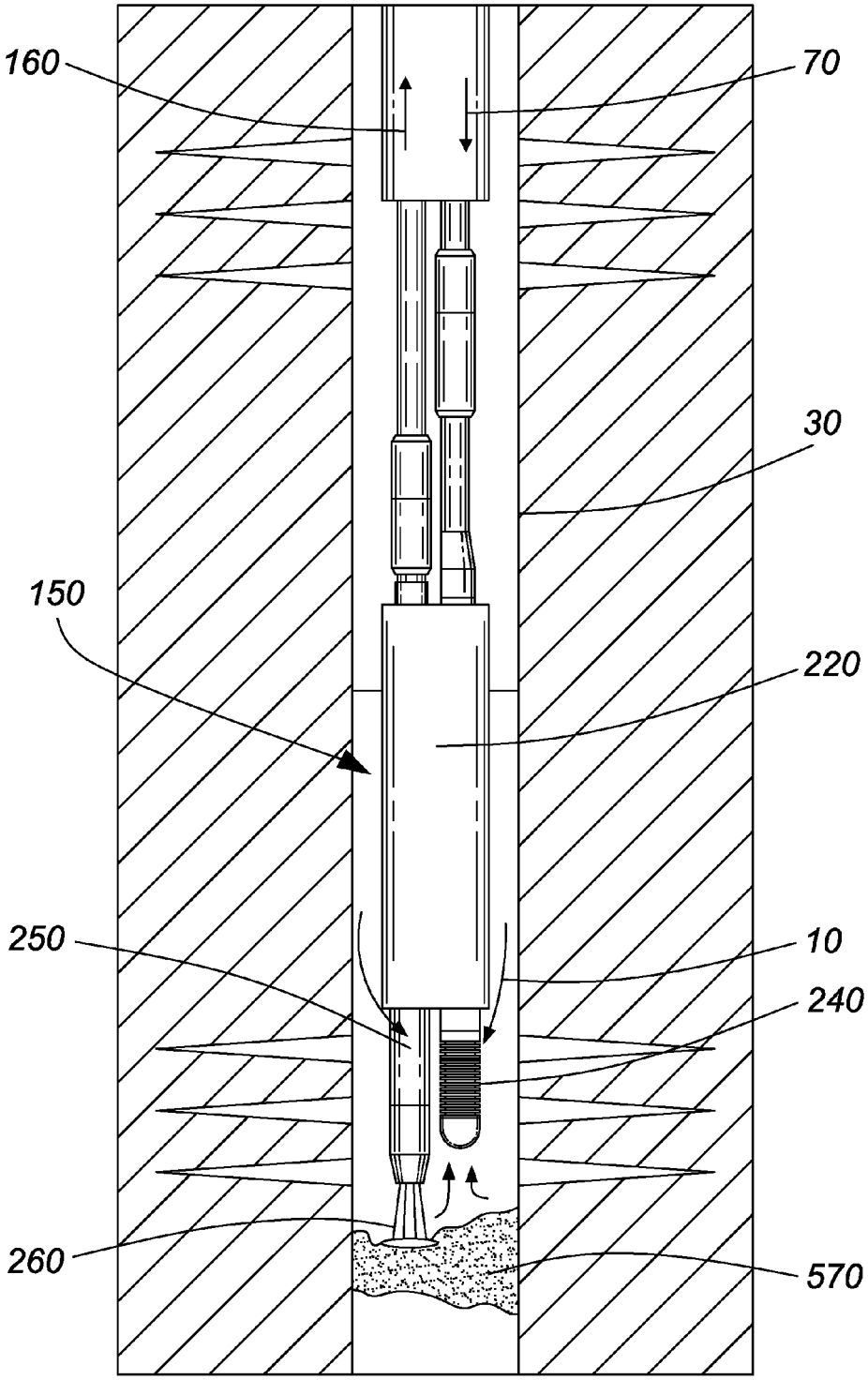
FIG. 25 depicts a method of the present invention of using the jet pump and multi-string tubing system of FIG. 23 to simultaneously remove wellbore fluid and eliminate obstructions from the wellbore.

FIG. 25 illustrates a further embodiment of a method of using the jet pump 150 of FIG. 23. Wellbore fluid 10 may be pumped to the surface by the jet pump 150 while jetting fluid 260 flows from the jetting nozzle 270. A jet pump 150 having a jet pump body 220 as in, for example, FIG. 5 or 6 is suitable for use in the method of FIG. 25.

Method of Using a Jet Pump Including an Auxiliary Tubing String

Figure 26:
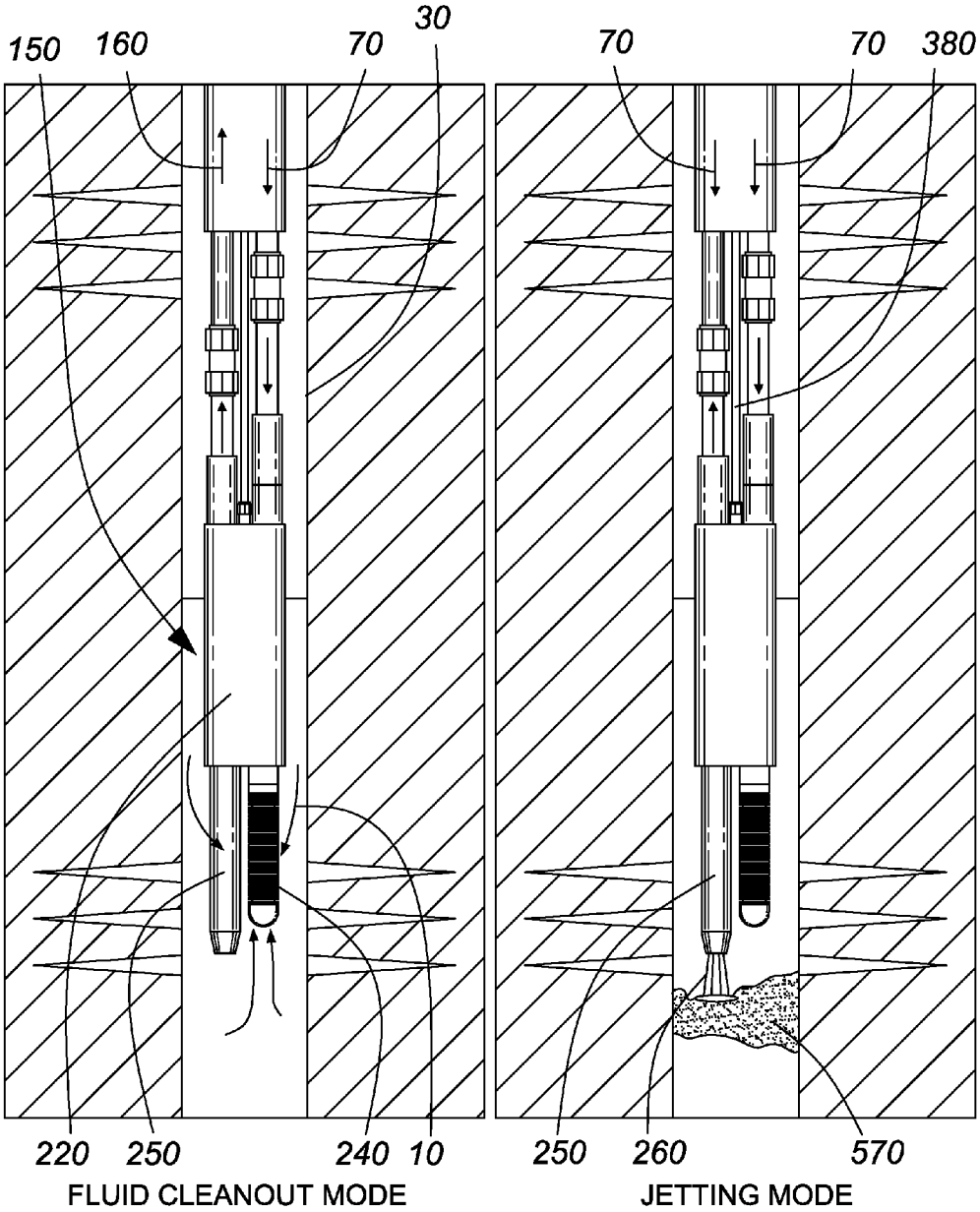
FIG. 26 depicts a method of the present invention of using one embodiment of a jet pump and multi-string tubing system to sequentially remove wellbore fluid and eliminate obstructions from the wellbore.

FIG. 26 illustrates a further embodiment of a method of using a jet pump 150. The jet pump 150 further includes an auxiliary tubing string 380 in fluid communication with the jetting sub 250, and may have a jet pump body 220 configured, for example, as in FIG. 9. Similarly to the method of FIG. 23, the jet pump 150 may be used in fluid cleanout mode or jetting mode. Changing from the fluid cleanout mode to the jetting mode may be accomplished by flowing jetting fluid 260 through the auxiliary tubing string 380, and reducing or removing fluid pressure from a supply tubing string 110. Changing from the jetting mode to the fluid cleanout mode may be accomplished by ceasing to flow jetting fluid 260 through the auxiliary tubing string 380 and providing power fluid 70 to the supply tubing string 110 at a sufficient fluid pressure to generate suction at the jet pump intake 240.

Figure 27:
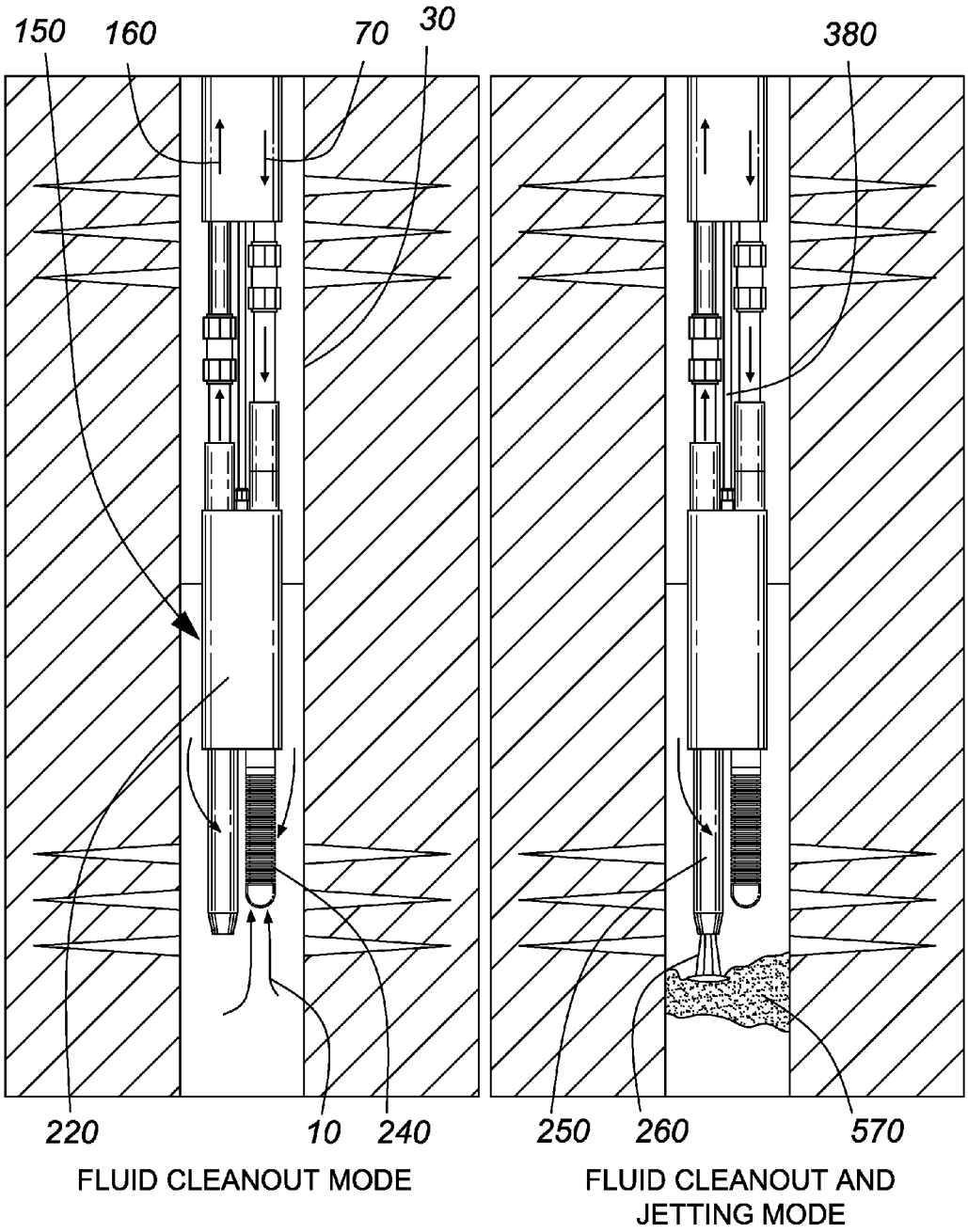
FIG. 27 depicts a method of the present invention of using the jet pump and multi-string tubing system of FIG. 26 to sequentially remove wellbore fluid, and simultaneously remove wellbore fluid and eliminate obstructions from the wellbore.

FIG. 27 illustrates a further embodiment of a method of using the jet pump 150 of FIG. 26. Similarly to the method of FIG. 24, the jet pump 150 may be used in the fluid cleanout mode or in fluid cleanout and jetting mode. Changing from the fluid cleanout mode to jetting and fluid cleanout mode may be accomplished by flowing jetting fluid 260 through the auxiliary tubing string 380. Changing from the jetting and fluid cleanout mode to the fluid cleanout mode may be accomplished by ceasing to flow jetting fluid 260 through the auxiliary tubing string 380.

Figure 28:
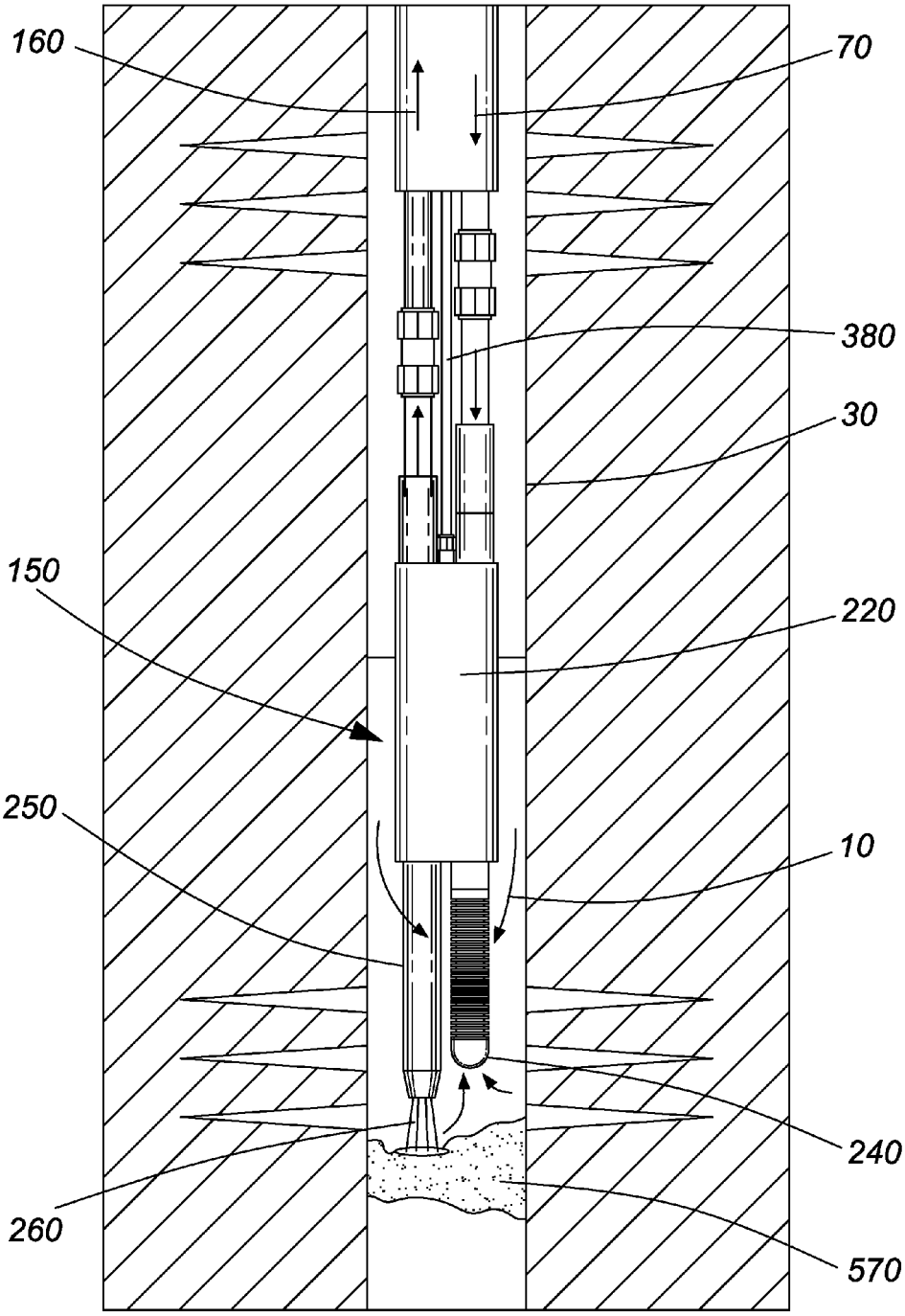
FIG. 28 depicts a method of the present invention of using the jet pump and multi-string tubing system of FIG. 26 to simultaneously remove wellbore fluid and eliminate obstructions from the wellbore.

FIG. 28 illustrates a further embodiment of a method of using the jet pump 150 of FIG. 26. Wellbore fluid 10 may be pumped to the surface by the jet pump 150 while jetting fluid 260 continuously flows from the jetting nozzle 270.

Method of Using a Jet Pump Including a Jetting Flow Valve

Figure 29:
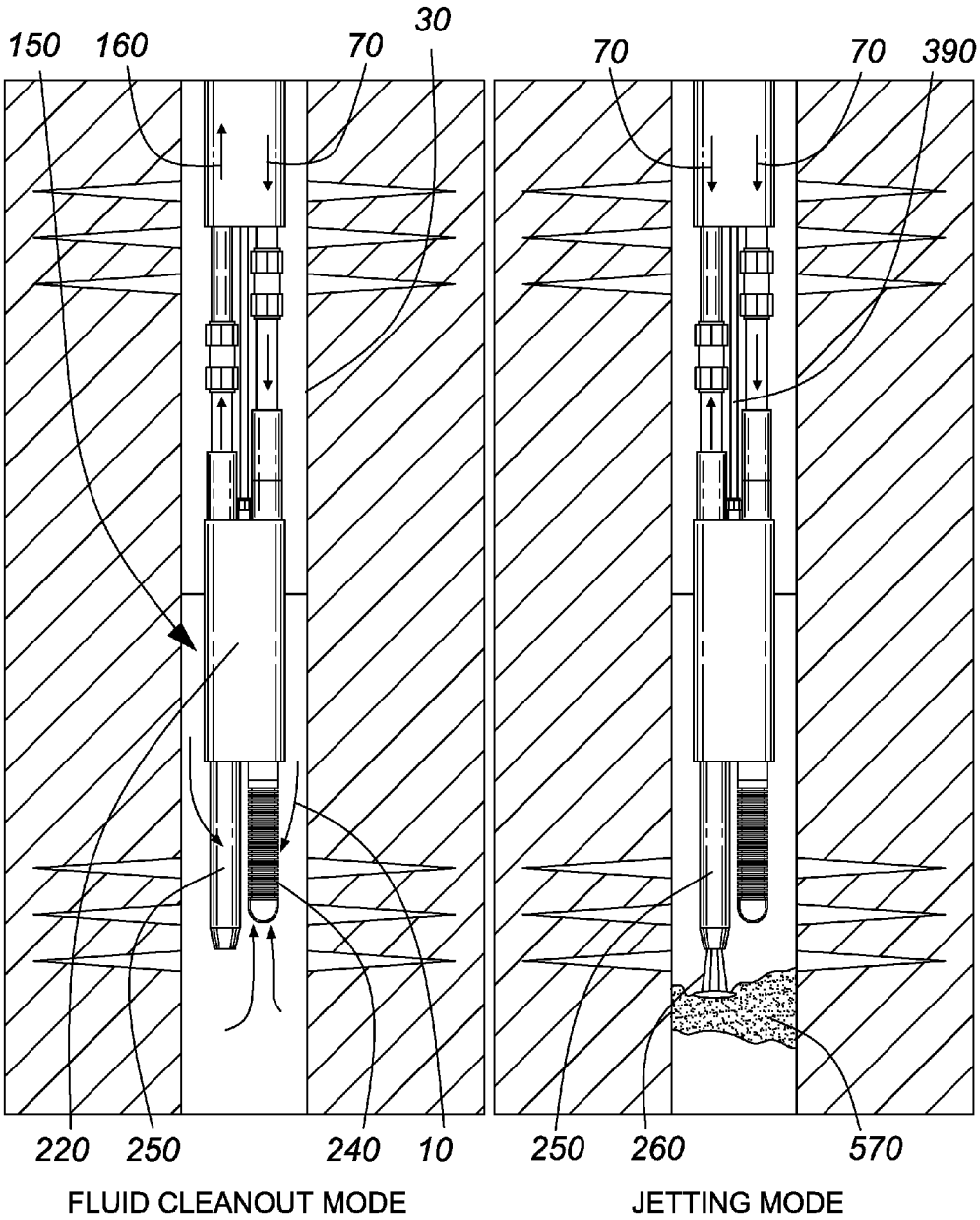
FIG. 29 depicts a method of the present invention of using one embodiment of a jet pump and multi-string tubing system to sequentially remove wellbore fluid and eliminate obstructions from the wellbore.

FIG. 29 illustrates a further embodiment of a method of using a jet pump 150. The jet pump 150 further includes a communications line 390 and may have a jet pump body 220 configured, for example as that in FIG. 12, wherein the communications line 390 is in operative communication with a jetting flow valve 420 located along a jetting flow passage 340 (FIG. 12). Similarly to the method of FIG. 23, the jet pump 150 may be used in fluid cleanout mode or jetting mode. Changing from the fluid cleanout mode to the jetting mode may be accomplished by causing the jetting flow valve 420 to allow fluid communication between a supply tubing string 110 and the jetting sub 250 (FIG. 12), and reconfiguring a return tubing string 120 such that power fluid 70 is supplied to the jet pump body 220 through both the supply tubing string 110 and the return tubing string 120. The same change may be accomplished by blocking the return tubing string 120. Changing from the jetting mode to the fluid cleanout mode may be accomplished by reconfiguring the return tubing string 120 to remove wellbore fluid 10 and by causing the jetting flow valve 420 to prevent fluid communication between the supply tubing string 110 and the jetting sub 250 (FIG. 12).

Figure 30:
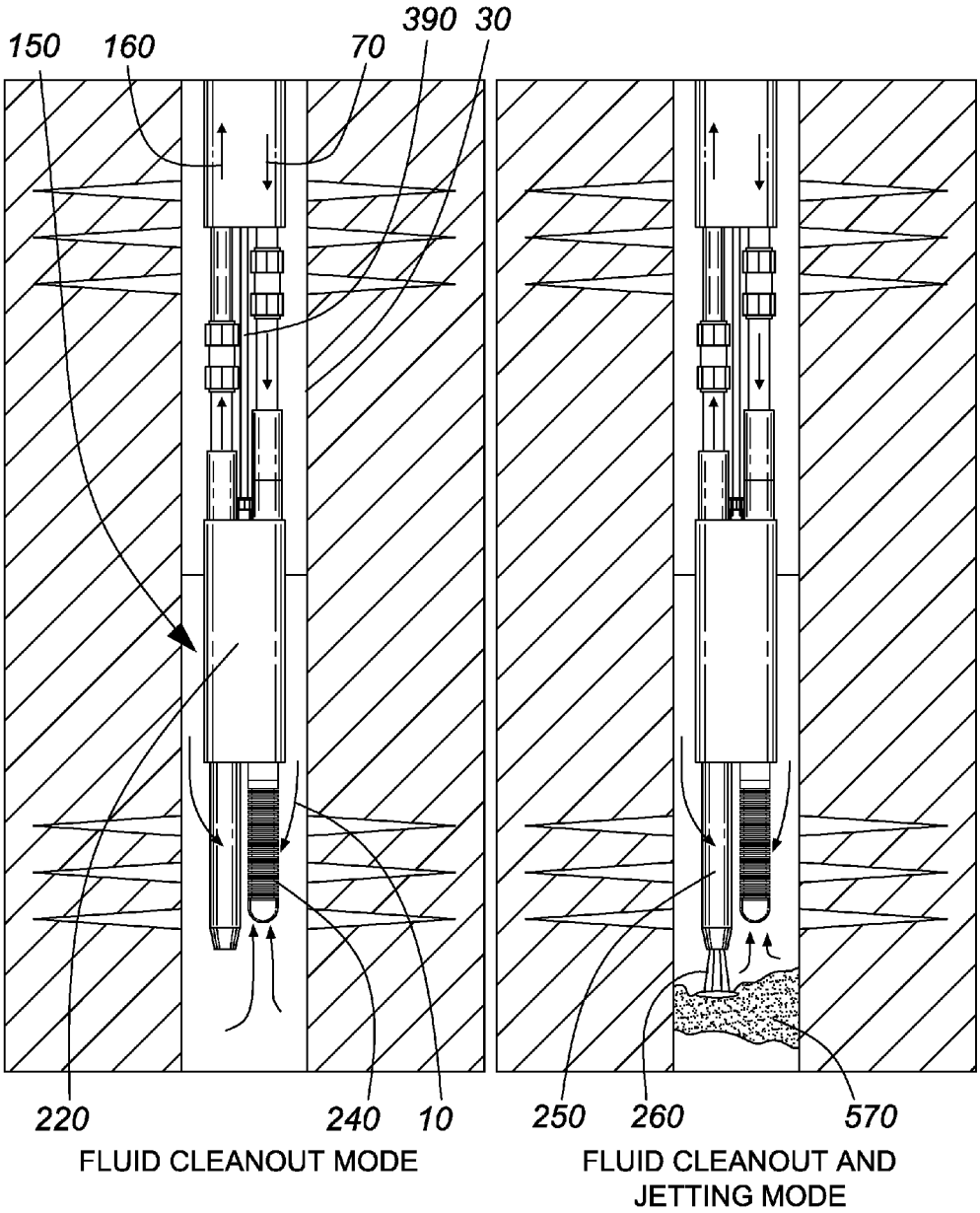
FIG. 30 depicts a method of the present invention of using the jet pump and multi-string tubing system of FIG. 29 to sequentially remove wellbore fluid, and simultaneously remove wellbore fluid and eliminate obstructions from the wellbore.

FIG. 30 illustrates a further embodiment of a method of using the jet pump 150 of FIG. 29. Similarly to the method of FIG. 24, the jet pump 150 may be used in the fluid cleanout mode or fluid cleanout and jetting mode. Changing from the fluid cleanout mode to jetting and fluid cleanout mode may be accomplished by causing the jetting flow valve 420 to allow fluid communication between a supply tubing string 110 and the jetting sub 250 (FIG. 12).

Figure 31:
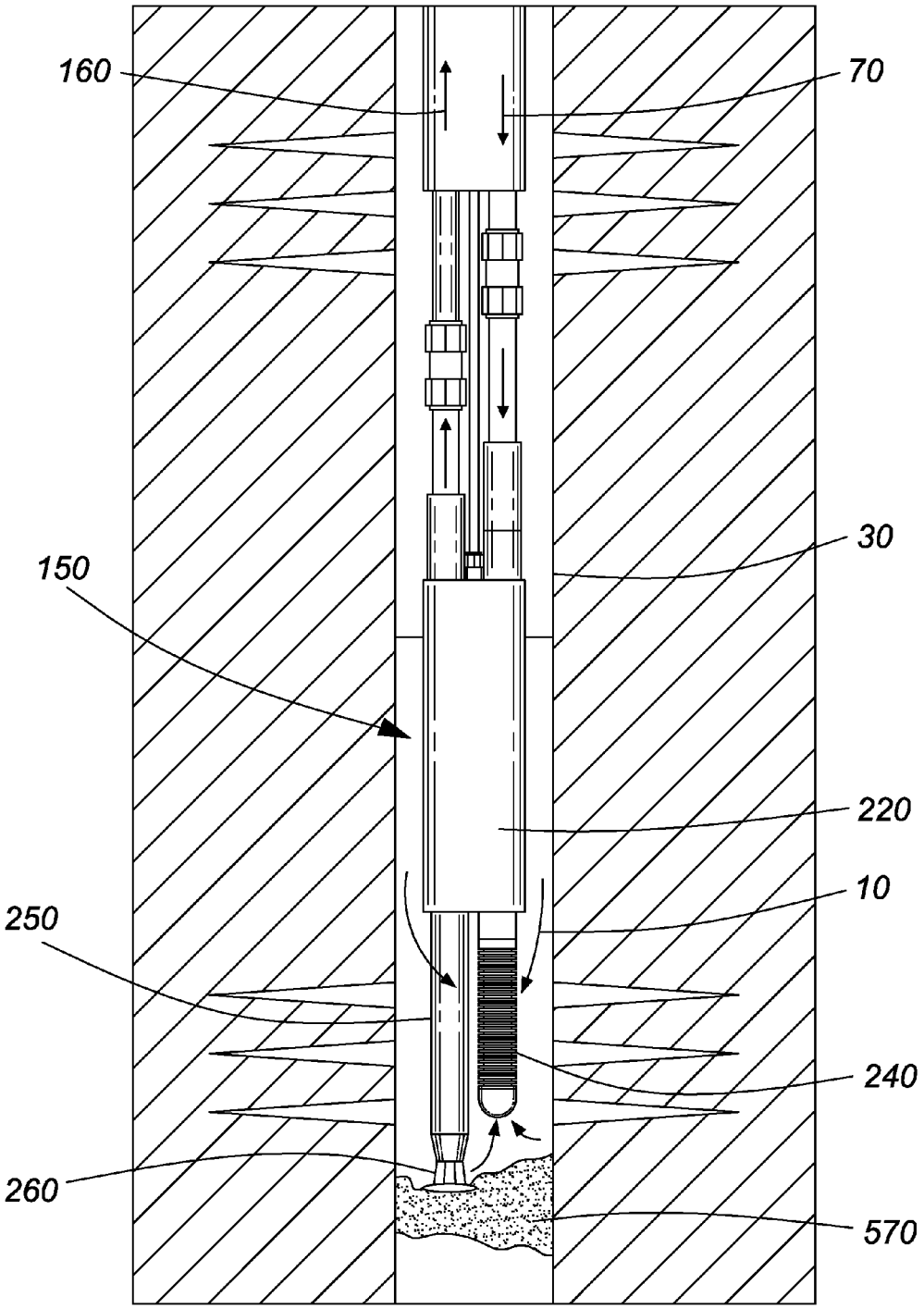
FIG. 31 depicts a method of the present invention of using the jet pump and multi-string tubing system of FIG. 29 to simultaneously remove wellbore fluid and eliminate obstructions from the wellbore.

FIG. 31 illustrates a further embodiment of a method of using the jet pump 150 of FIG. 29. Wellbore fluid 10 may be pumped to the surface by the jet pump 150 while jetting fluid 260 continuously flows from the jetting nozzle 270.

Figure 32:
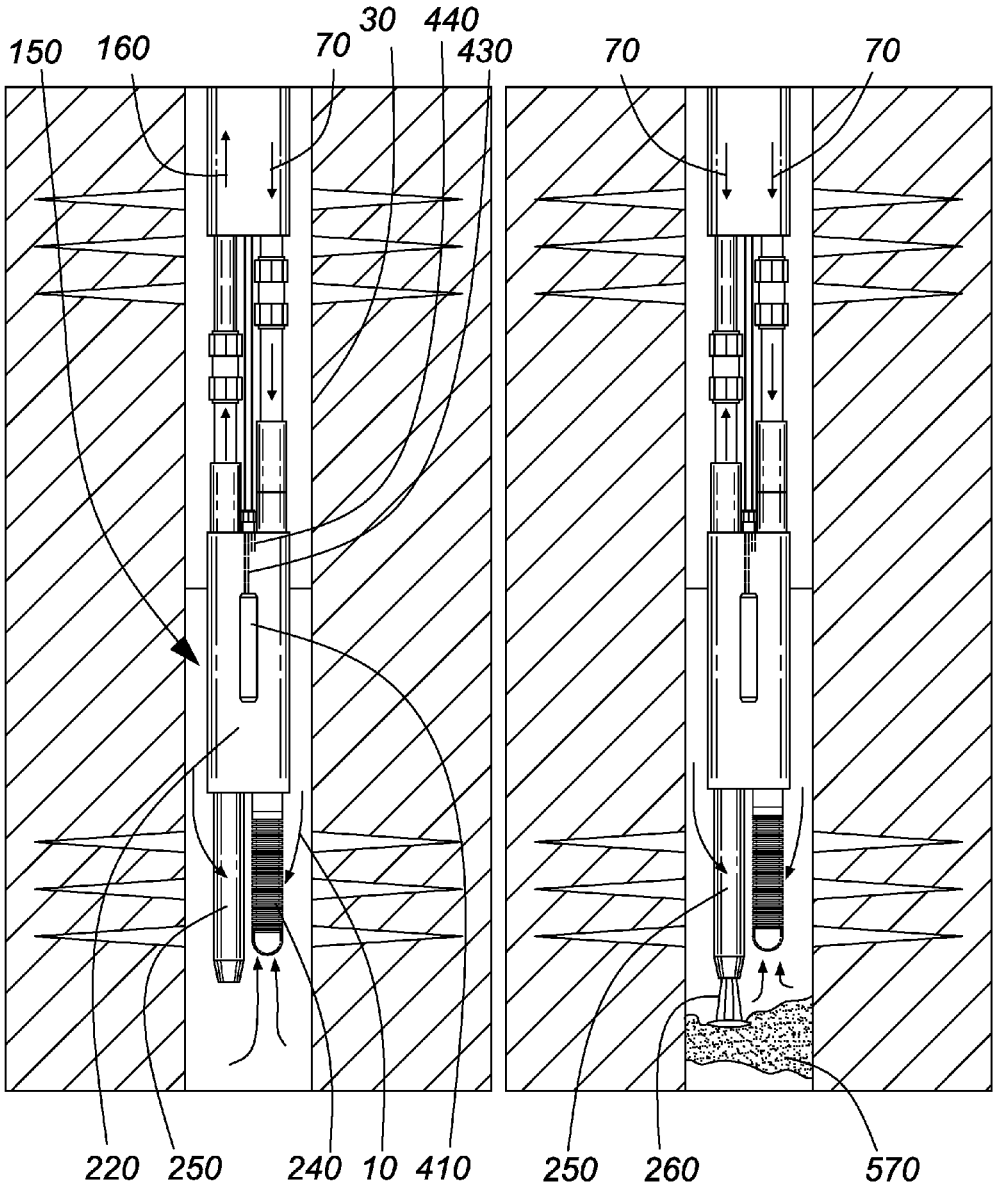
FIG. 32 depicts a method of the present invention of using one embodiment of a jet pump and multi-string tubing system to sequentially remove wellbore fluid and eliminate obstructions from the wellbore.

Method of Using a Jet Pump Including a Jetting Flow Valve and a Data-Sensing Sub FIG. 32 illustrates a further embodiment of a method of using a jet pump 150. The jet pump 150 further includes a first communications line 430 and a second communications line 440, and may have a jet pump body 220 configured, for example as that in FIGS. 13 and 15, wherein a data-sensing sub 410 is operatively connected with the first communications line 430, and a jetting flow valve 420 inside the jet pump body 220 is operatively connected with the second communications line 440. Similarly to the method of FIG. 23, the jet pump 150 may be used in the fluid cleanout mode or the jetting mode. Changing from the fluid cleanout mode to the jetting mode may be accomplished as in the method of FIG. 29, with reference to FIG. 15 rather than to FIG. 12, and with the additional step of receiving data returned from the data-sensing sub 410. The data received from the data-sensing sub 410 may be relevant to selection of, for example, a mode of operation or a pressure at which to administer either power fluid 70 or jetting fluid 260.

Figure 33:
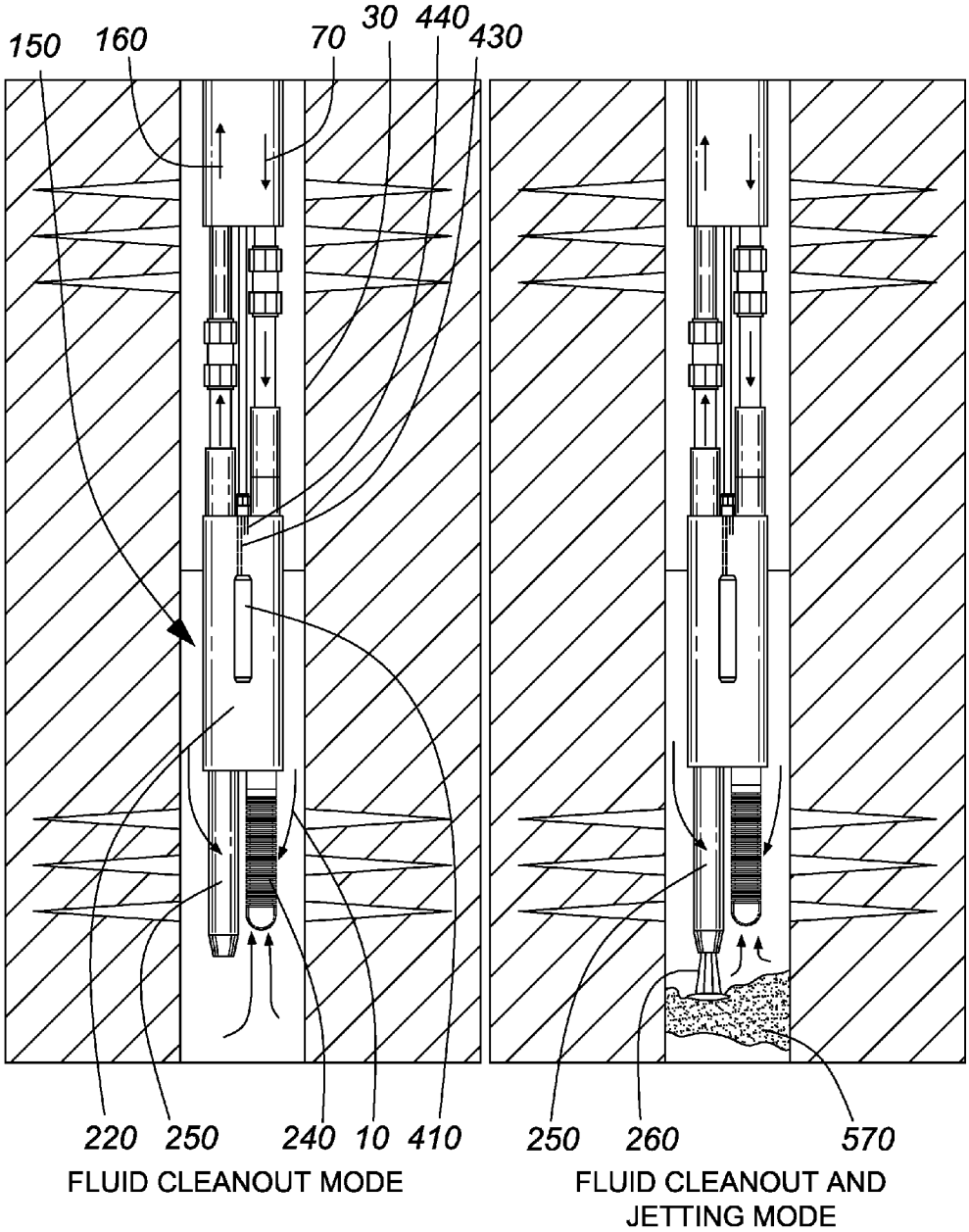
FIG. 33 depicts a method of the present invention of using the jet pump and multi-string tubing system of FIG. 32 to sequentially remove wellbore fluid, and simultaneously remove wellbore fluid and eliminate obstructions from the wellbore.

FIG. 33 illustrates a further embodiment of a method of using the jet pump 150 of FIG. 32. Similarly to the method of FIG. 24, the jet pump 150 may be used in fluid cleanout mode or fluid cleanout and jetting mode. Changing from the fluid cleanout mode to the fluid cleanout and jetting mode may be accomplished as in the method of FIG. 30, with reference to FIG. 15 rather than to FIG. 12, and with the additional step of receiving data returned from the data-sensing sub 410. The data received from the data-sensing sub 410 may be relevant to selection of, for example, a mode of operation or a pressure at which to administer either power fluid 70 or jetting fluid 260.

Figure 34:
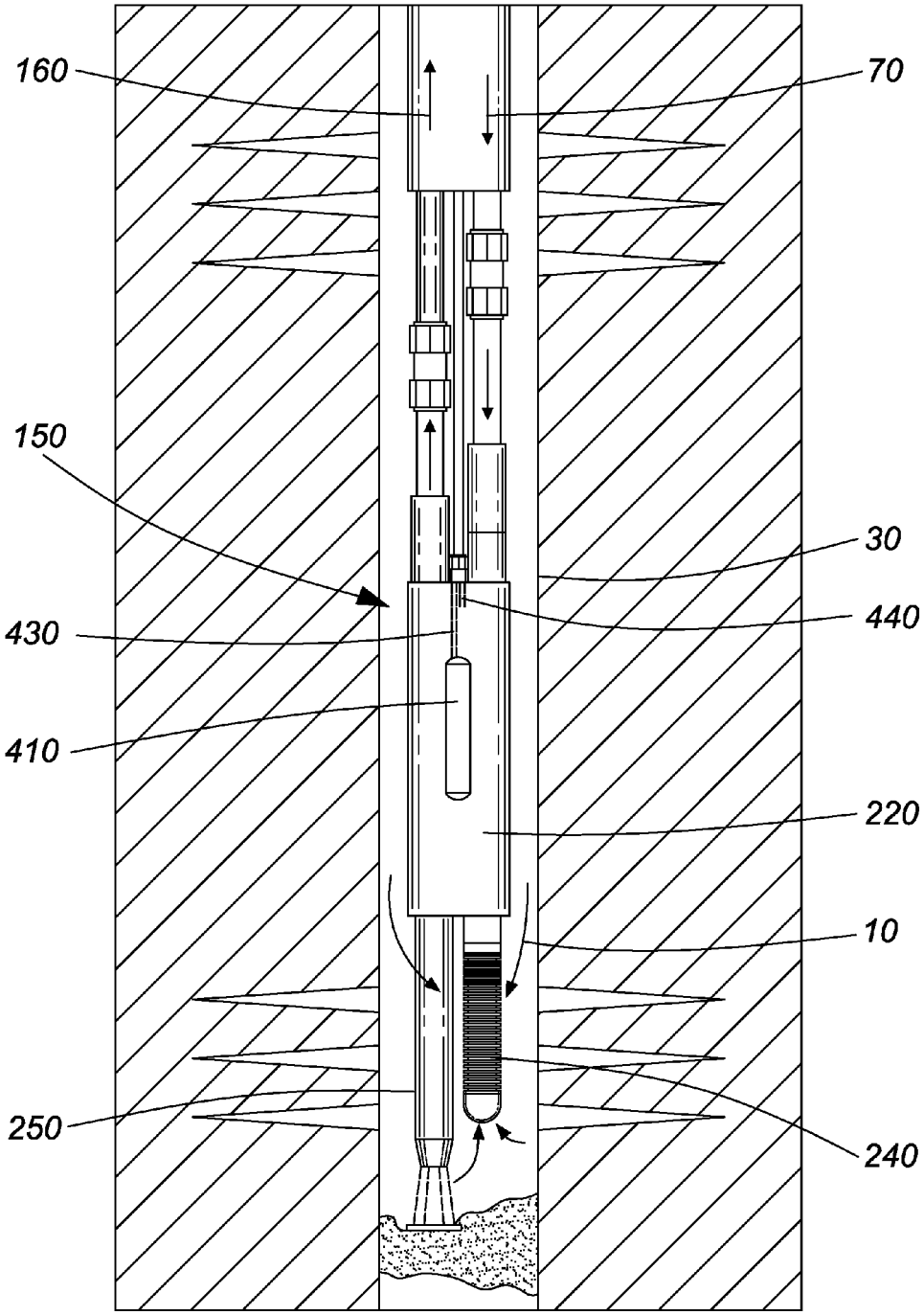
FIG. 34 depicts a method of the present invention of using the jet pump and multi-string tubing system of FIG. 32 to simultaneously remove wellbore fluid and eliminate obstructions from the wellbore.

FIG. 34 illustrates a further embodiment of a method of using the jet pump 150 of FIG. 32. Wellbore fluid 10 may be pumped to the surface by the jet pump 150 while jetting fluid 260 continuously flows from the jetting nozzle 270. The data-sensing sub 410 operatively connected to a second communications line 440 receives data from the wellbore 30.

A data-sensing sub 410 operatively connected to a communications line 390 may be incorporated into the jet pump 150 of any of the methods of FIGS. 23-31 and used in an analogous way to the data-sensing sub 410 of the jet pump 150 of FIGS. 32-34.

Jetting Sub with Lateral Jetting Ports

Figure 35:
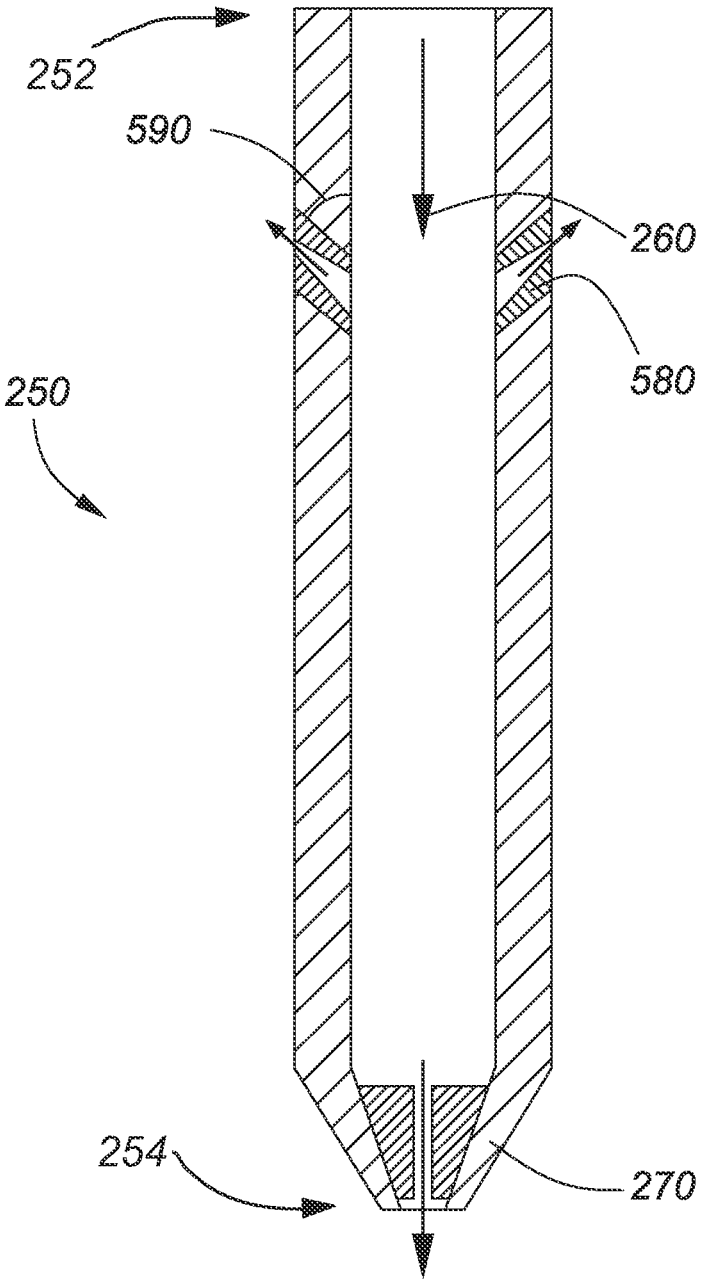
FIG. 35 is a jetting sub of the present invention having lateral jetting ports.

FIG. 35 depicts a jetting sub 250 for a jet pump 150 (FIG. 2), having one or more lateral jetting ports 580. The lateral jetting ports 580 may oriented at an angle 590 relative to the longitudinal axis of the jetting sub 250. The angle 590 may be between, about 0 degrees and about +/−90 degrees. The angle 590 may be, for example, −85, −75, −60, −45, −30, −15, 0, +15, +30, +45, +60, +75, or +85. An extension member (not shown) may be present to allow the lateral jetting ports to direct jetting fluid 260 vertically uphole (−90 degrees) or vertically downhole (+90 degrees). In addition, the lateral jetting ports 580 may extend radially or they may be skewed relative to the radial axis of the jetting sub 250 with the same wide range of angles as in the longitudinal axis of the jetting sub 250.

When jetting fluid 260 flows from the jetting nozzle 270, it also flows from the lateral jetting ports 580. Jetting fluid 260 flowing from the lateral jetting ports 580 may more effectively entrain particulates in wellbore fluid 10 (FIG. 23), for example those present in a wellbore obstruction 570 (FIG. 23), which may facilitate removal of wellbore fluid 10 (FIG. 23) from the wellbore 30 (FIG. 23) by the jet pump intake 240 (FIG. 23).

Figure 36:
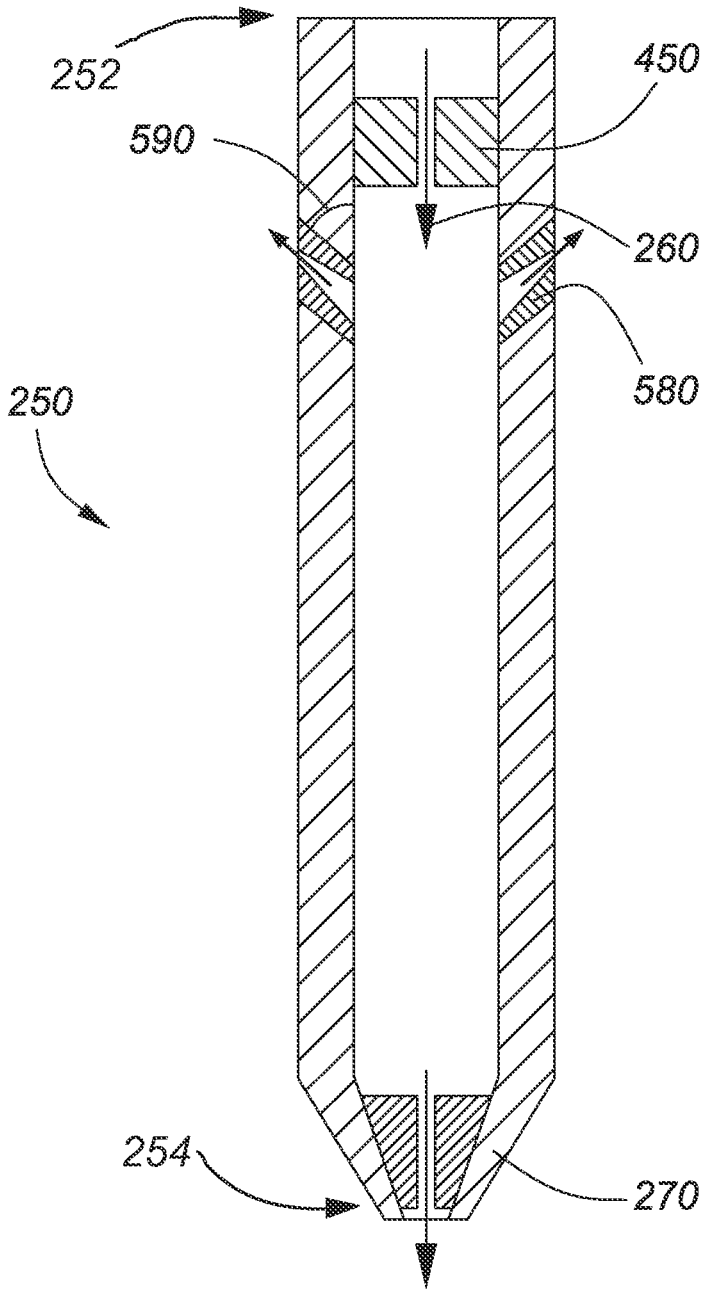
FIG. 36 is a jetting sub of the present invention having a flow control choke and lateral jetting ports.

FIG. 36 depicts a jetting sub 250 for a jet pump 150 (FIG. 2), having an upper flow control choke 450 proximate the uphole end 252 and one or more lateral jetting ports 580.

Figure 37:
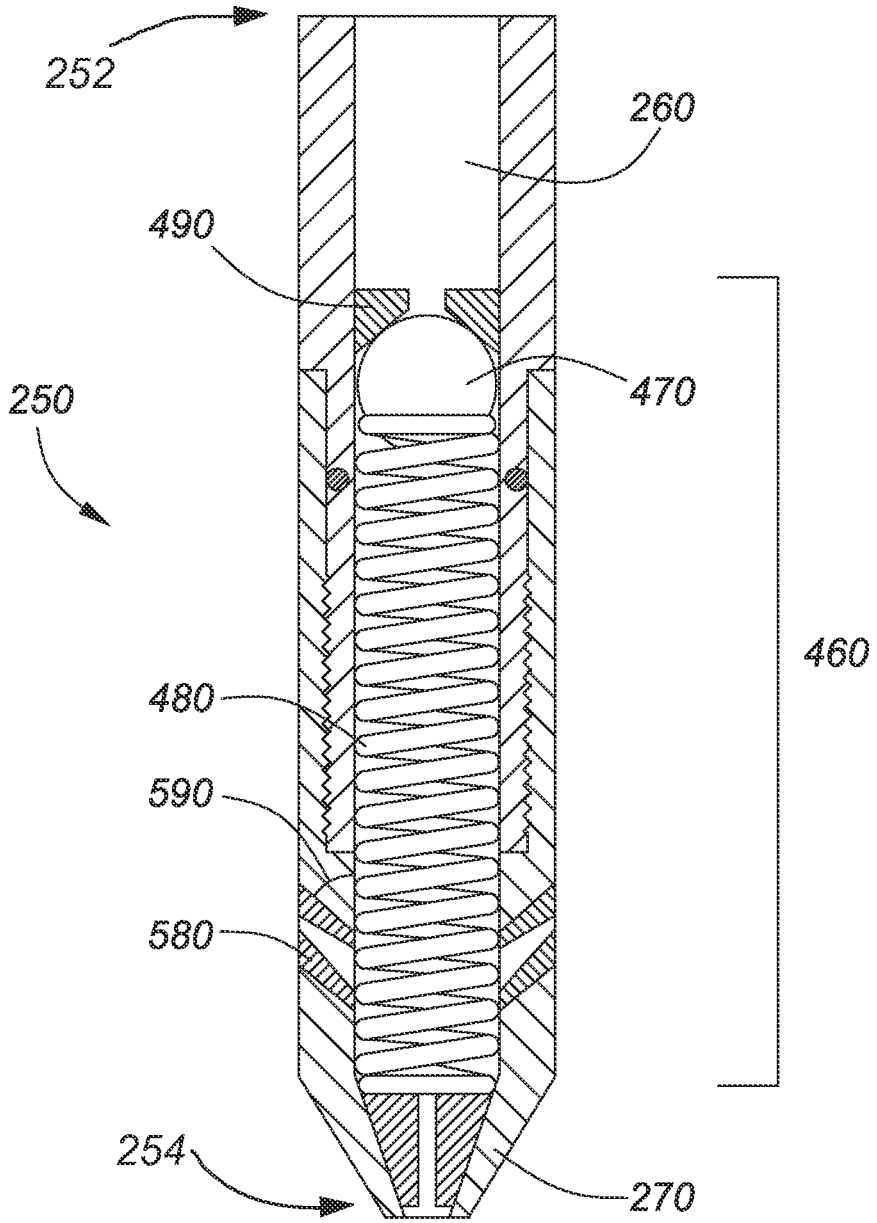
FIG. 37 is a jetting sub of the present invention having a back-pressure valve and lateral jetting ports.

FIG. 37 depicts a jetting sub 250 for a jet pump 150 (FIG. 2), having one or more lateral jetting ports 580, and wherein access by jetting fluid 260 to the jetting nozzle 270 is subject to a back-pressure valve 460.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A jet pump adapted for use with a spoolable multi-string tubing system comprising two or more conduits, the conduits including a supply tubing string and a return tubing string laterally disposed with respect to one another, the conduits being substantially parallel, and the jet pump comprising:

a body;

a power fluid inlet in the body for connecting to the supply tubing string;

a venturi nozzle and a diffuser in fluid communication with the power fluid inlet;

a venturi gap between the venturi nozzle and the diffuser for creating a low pressure condition at the venturi gap when power fluid flows through the venturi nozzle and past the venturi gap;

a jet pump intake in fluid communication with the venturi gap for flow of wellbore fluid into the jet pump intake when the low pressure condition is created, the wellbore fluid combining with power fluid to form return fluid at the venturi gap;

a return tube in fluid communication with the diffuser for receiving the return fluid from the diffuser;

a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string; and a jetting sub having an uphole end and a downhole end, the jetting sub in fluid communication with the power fluid inlet for emitting jetting fluid externally to the jet pump, the jetting sub comprising a jetting nozzle proximate the downhole end for flowing jetting fluid out of and an upper flow control choke proximate the uphole end for limiting flow of fluid if the jetting nozzle washes out.

2. The jet pump of claim 1, the jetting sub comprising a back-pressure valve.

3. The jet pump of claim 1, further comprising a check valve.

4. The jet pump of claim 1, wherein the body is a unibody jet pump body.

5. The jet pump of claim 1, wherein the body is a double-barrel jet pump body.

6. A jet pump adapted for use with a spoolable multi-string tubing system comprising two or more conduits, the conduits including a supply tubing string and a return tubing string laterally disposed with respect to one another, the conduits being substantially parallel, and the jet pump comprising:

a body;

a power fluid inlet in the body for connecting to the supply tubing string;

a venturi nozzle and a diffuser in fluid communication with the power fluid inlet;

a venturi gap between the venturi nozzle and the diffuser for creating a low pressure condition at the venturi gap when power fluid flows through the venturi nozzle and past the venturi gap;

a jet pump intake in fluid communication with the venturi gap for flow of wellbore fluid into the jet pump intake when the low pressure condition is created, the wellbore fluid combining with power fluid to form return fluid at the venturi gap;

a return tube in fluid communication with the diffuser for receiving the return fluid from the diffuser;

a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string; and a jetting sub having an uphole end and a downhole end, the jetting sub in fluid communication with the power fluid inlet for emitting jetting fluid externally to the jet pump, the jetting sub comprising one or more lateral jetting ports oriented at an angle relative to a longitudinal axis of the jetting sub of between about −15 degrees and about +15 degrees.

7. A jet pump adapted for use with a spoolable multi-string tubing system comprising two or more conduits, the conduits including a supply tubing string and a return tubing string laterally disposed with respect to one another, the conduits being substantially parallel, and the jet pump comprising:

a body;

a power fluid inlet in the body for connecting to the supply tubing string;

a venturi nozzle and a diffuser in fluid communication with the power fluid inlet;

a venturi gap between the venturi nozzle and the diffuser for creating a low pressure condition at the venturi gap when power fluid flows through the venturi nozzle and past the venturi gap;

a jet pump intake in fluid communication with the venturi gap for flow of wellbore fluid into the jet pump intake when the low pressure condition is created, the wellbore fluid combining with power fluid to form return fluid at the venturi gap;

a return tube in fluid communication with the diffuser for receiving the return fluid from the diffuser;

a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string; and a jetting sub having an uphole end and a downhole end, the jetting sub in fluid communication with the power fluid inlet for emitting jetting fluid externally to the jet pump and comprising a jetting nozzle proximate the downhole end for flowing jetting fluid out of; the jetting nozzle comprising a converging jetting passage and a diverging jetting passage, the converging jetting passage and the diverging jetting passage forming a jetting pinch, the dimensions of the jetting pinch selected to provide back-pressure for the jetting nozzle.

8. The jet pump of claim 7, the jetting nozzle further comprising an abrasion-resistant elastomeric insert located radially outward from the diverging jetting passage.

9. The jet pump of claim 7, the jetting nozzle further comprising a jetting passage insert reversibly connected with the jetting nozzle, the converging jetting passage being present on the insert.

10. The jet pump of claim 7, the jetting nozzle further comprising a disposable nose reversibly connected with the jetting nozzle, the diverging jetting passage being present on the disposable nose.

11. A jet pump adapted for use with a spoolable multi-string tubing system comprising two or more conduits, the conduits including a supply tubing string and a return tubing string laterally disposed with respect to one another, the conduits being substantially parallel, and the jet pump comprising:

a body;

a power fluid inlet in the body for connecting to the supply tubing string;

a venturi nozzle and a diffuser in fluid communication with the power fluid inlet;

a venturi gap between the venturi nozzle and the diffuser for creating a low pressure condition at the venturi gap when power fluid flows through the venturi nozzle and past the venturi gap;

a jet pump intake in fluid communication with the venturi gap for flow of wellbore fluid into the jet pump intake when the low pressure condition is created, the wellbore fluid combining with power fluid to form return fluid at the venturi gap;

a return tube in fluid communication with the diffuser for receiving the return fluid from the diffuser;

a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string, and the jet pump intake comprising slots having an opening dimension selected relative to the venturi gap to prevent intake of particulates large enough to plug the venturi gap.

12. A method of cleaning a wellbore comprising:

providing a spoolable multi-string tubing system comprising two or more conduits, the two or more conduits comprising a supply tubing string and a return tubing string;

providing a jet pump comprising:

a body;

a power fluid inlet in the body for connecting to the supply tubing string;

a venturi nozzle and a diffuser in fluid communication with the power fluid inlet;

a venturi gap between the venturi nozzle and the diffuser for creating a low pressure condition at the venturi gap when power fluid flows through the venturi nozzle and past the venturi gap;

a jet pump intake in fluid communication with the venturi gap for flow of wellbore fluid into the jet pump intake when the low pressure condition is created, the wellbore fluid combining with power fluid to form return fluid at the venturi gap;

a return tube in fluid communication with the diffuser for receiving the return fluid from the diffuser;

a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string; and a jetting sub in fluid communication with the power fluid inlet for emitting jetting fluid externally to the jet pump;

establishing fluid communication between the two or more conduits and the jet pump;

deploying the jet pump into the wellbore;

providing power fluid to the jet pump via the supply tubing string;

receiving return fluid from the jet pump via the return tubing string; and flowing jetting fluid out of the jetting nozzle while receiving return fluid from the jet pump via the return tubing string.

13. A method of cleaning a wellbore comprising:

providing a spoolable multi-string tubing system comprising two or more conduits, the two or more conduits comprising a supply tubing string and a return tubing string;

providing a jet pump comprising a body;

a power fluid inlet in the body for connecting to the supply tubing string;

a venturi nozzle and a diffuser in fluid communication with the power fluid inlet;

a venturi gap between the venturi nozzle and the diffuser for creating a low pressure condition at the venturi gap when power fluid flows through the venturi nozzle and past the venturi gap;

a jet pump intake in fluid communication with the venturi gap for flow of wellbore fluid into the jet pump intake when the low pressure condition is created, the wellbore fluid combining with power fluid to form return fluid at the venturi gap;

a return tube in fluid communication with the diffuser for receiving the return fluid from the diffuser;

a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string; and a jetting sub in fluid communication with the power fluid inlet for emitting jetting fluid externally to the jet pump;

establishing fluid communication between the two or more conduits and the jet pump;

deploying the jet pump into the wellbore;

providing power fluid to the jet pump via the supply tubing string;

receiving return fluid from the jet pump via the return tubing string;

ceasing to receive return fluid from the jet pump via the return tubing string;

flowing jetting fluid out of the jetting sub;

ceasing to flow jetting fluid out of the jetting sub; and receiving return fluid from the jet pump via the return tubing string.

14. A method of cleaning a wellbore comprising:

providing a spoolable multi-string tubing system comprising two or more conduits, the two or more conduits comprising a supply tubing string and a return tubing string;

providing a jet pump comprising:

a body;

a power fluid inlet in the body for connecting to the supply tubing string;

a venturi nozzle and a diffuser in fluid communication with the power fluid inlet;

a venturi gap between the venturi nozzle and the diffuser for creating a low pressure condition at the venturi gap when power fluid flows through the venturi nozzle and past the venturi gap;

a jet pump intake in fluid communication with the venturi gap for flow of wellbore fluid into the jet pump intake when the low pressure condition is created, the wellbore fluid combining with power fluid to form return fluid at the venturi gap;

a return tube in fluid communication with the diffuser for receiving the return fluid from the diffuser;

a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string; and a jetting sub comprising a back-pressure valve, the jetting sub in fluid communication with the power fluid inlet for emitting jetting fluid externally to the jet pump;

establishing fluid communication between the two or more conduits and the jet pump;

deploying the jet pump into the wellbore; providing power fluid to the jet pump via the supply tubing string;

receiving return fluid from the jet pump via the return tubing string; and flowing jetting fluid out of the jetting nozzle while receiving return fluid from the jet pump via the return tubing string.

15. A method of cleaning a wellbore comprising:

providing a spoolable multi-string tubing system comprising two or more conduits, the two or more conduits comprising a supply tubing string and a return tubing string;

providing a jet pump comprising:

a body;

a power fluid inlet in the body for connecting to the supply tubing string;

a venturi nozzle and a diffuser in fluid communication with the power fluid inlet;

a venturi gap between the venturi nozzle and the diffuser for creating a low pressure condition at the venturi gap when power fluid flows through the venturi nozzle and past the venturi gap;

a jet pump intake in fluid communication with the venturi gap for flow of wellbore fluid into the jet pump intake when the low pressure condition is created, the wellbore fluid combining with power fluid to form return fluid at the venturi gap;

a return tube in fluid communication with the diffuser for receiving the return fluid from the diffuser;

a return fluid outlet in the body and in fluid communication with the return tube, for connecting to the return tubing string, the return fluid outlet laterally disposed with respect to the power fluid inlet for connecting the power fluid inlet to the supply tubing string and the return fluid outlet to the return tubing string; and a jetting sub comprising a back-pressure valve, the jetting sub in fluid communication with the power fluid inlet for emitting jetting fluid externally to the jet pump;

establishing fluid communication between the two or more conduits and the jet pump;

deploying the jet pump into the wellbore; providing power fluid to the jet pump via the supply tubing string;

receiving return fluid from the jet pump via the return tubing string;

ceasing to receive return fluid from the jet pump via the return tubing string;

flowing jetting fluid out of the jetting sub;

ceasing to flow jetting fluid out of the jetting sub; and receiving return fluid from the jet pump via the return tubing string.

* * * * *